US009911389B2

(12) United States Patent
Whitehead et al.

(10) Patent No.: US 9,911,389 B2
(45) **Date of Patent: *Mar. 6, 2018**

(54) LOCALLY DIMMED QUANTUM DOT DISPLAY

(71) Applicant: Dolby Laboratories Licensing Corporation, San Francisco, CA (US)

(72) Inventors: Lorne A. Whitehead, Vancouver (CA); Gregory John Ward, Berkeley, CA (US); Louis D. Silverstein, Scottsdale, AZ (US); Helge Seetzen, Westmount (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/298,094

(22) Filed: Oct. 19, 2016

(65) Prior Publication Data

US 2017/0039963 A1 Feb. 9, 2017

Related U.S. Application Data

(63) Continuation of application No. 14/749,195, filed on Jun. 24, 2015, now Pat. No. 9,478,182, which is a (Continued)

(51) Int. Cl.

| | |
|---|---|
| ***G09G 3/34*** | (2006.01) |
| ***G09G 3/36*** | (2006.01) |
| ***G09G 3/32*** | (2016.01) |

(52) U.S. Cl.

CPC ..... *G09G 3/3607* (2013.01); *G09G 3/32* (2013.01); *G09G 3/3406* (2013.01); (Continued)

(58) Field of Classification Search

CPC ..... G09G 3/3611; G09G 3/3426; G09G 3/32; G09G 3/3406; G09G 3/3433; (Continued)

(56) References Cited

U.S. PATENT DOCUMENTS

| | | | |
|---|---|---|---|
| 4,170,771 | A | 10/1979 | Bly |
| 4,229,095 | A | 10/1980 | Mir |

(Continued)

FOREIGN PATENT DOCUMENTS

| | | |
|---|---|---|
| CA | 2328235 | 10/1999 |
| CN | 1605041 | 4/2005 |

(Continued)

OTHER PUBLICATIONS

Endo, N. "Transmissive Type Liquid Crystal Display Device", Toshiba Technical Publication Collection, vol. 14-16, Issue 96:3642, Apr. 4, 1996.

(Continued)

*Primary Examiner* — Lun-Yi Lao
*Assistant Examiner* — Kelly Hegarty

(57) ABSTRACT

Dual modulator displays are disclosed incorporating a phosphorescent plate interposed in the optical path between a light source modulation layer and a display modulation layer. Spatially modulated light output from the light source modulation layer impinges on the phosphorescent plate and excites corresponding regions of the phosphorescent plate which in turn emit light having different spectral characteristics than the light output from the light source modulation layer. Light emitted from the phosphorescent plate is received and further modulated by the display modulation layer to provide the ultimate display output.

20 Claims, 8 Drawing Sheets

Related U.S. Application Data continuation of application No. 14/215,856, filed on Mar. 17, 2014, now Pat. No. 9,099,046, which is a continuation of application No. 12/707,276, filed on Feb. 17, 2010, now abandoned.

(60) Provisional application No. 61/154,866, filed on Feb. 24, 2009.

(52) U.S. Cl.
CPC ..... *G09G 3/3413* (2013.01); *G09G 3/3426* (2013.01); *G09G 3/3433* (2013.01); *G09G 3/3611* (2013.01); *G09G 2320/0646* (2013.01); *G09G 2320/0666* (2013.01); *G09G 2360/16* (2013.01)

(58) Field of Classification Search
CPC ..... G09G 2320/0646; G09G 2360/16; G09G 2320/0666
USPC ..... 345/3.1, 4, 30, 44, 73, 76.2, 204; 313/522
See application file for complete search history.

(56) References Cited

U.S. PATENT DOCUMENTS 4,316,196 A 2/1982 Jacobs
4,364,039 A 12/1982 Penz
4,374,397 A 2/1983 Mir
4,378,568 A 3/1983 Mir
4,441,791 A 4/1984 Hornbeck
4,559,480 A 12/1985 Nobs
4,580,877 A 4/1986 Washo
4,637,150 A 1/1987 Geluk
4,726,663 A 2/1988 Buzak
4,801,194 A 1/1989 Agostinelli
4,868,668 A 9/1989 Tavernetti
4,933,754 A 6/1990 Reed
4,954,789 A 9/1990 Sampsell
4,987,410 A 1/1991 Berman
4,995,719 A 2/1991 Shanks
5,050,965 A * 9/1991 Conner ..... G02F 1/13473 349/112
5,075,789 A 12/1991 Jones
5,103,328 A 4/1992 Numao
5,122,791 A 6/1992 Gibbons
5,138,441 A 8/1992 Tanaka
5,144,292 A 9/1992 Shiraishi
5,247,366 A 9/1993 Ginosar
5,386,253 A 1/1995 Fielding
5,461,397 A * 10/1995 Zhang ..... G02F 1/133604 345/102
5,537,233 A 7/1996 Miura
5,537,256 A 7/1996 Fergason
5,572,341 A 11/1996 Fergason
5,592,193 A 1/1997 Chen
5,639,158 A 6/1997 Sato
5,646,702 A 7/1997 Akinwande
5,652,672 A 7/1997 Huignard
5,666,174 A * 9/1997 Cupolo, III ..... G02F 1/133617 349/110
5,666,226 A 9/1997 Ezra
5,684,354 A 11/1997 Gleckman
5,715,029 A 2/1998 Fergason
5,717,422 A 2/1998 Fergason
5,724,062 A 3/1998 Hunter
5,729,242 A 3/1998 Margerum
5,737,045 A 4/1998 Abileah
5,748,828 A 5/1998 Steiner
5,754,159 A 5/1998 Wood
5,757,447 A * 5/1998 Kobayashi ..... G02F 1/133604 313/487
5,774,257 A 6/1998 Shibata
5,784,181 A 7/1998 Loiseaux
5,809,215 A 9/1998 Heydinger
5,844,540 A * 12/1998 Terasaki ..... G09G 3/3406 345/102
5,889,567 A 3/1999 Swanson
5,892,325 A 4/1999 Gleckman
5,920,361 A 7/1999 Gibeau
5,933,754 A 8/1999 Mathews
5,954,789 A 9/1999 Yu
5,959,777 A 9/1999 Whitehead
5,978,142 A 11/1999 Blackham
5,986,628 A 11/1999 Tuenge
6,031,328 A 2/2000 Nakamoto
6,043,591 A 3/2000 Gleckman
6,054,120 A 4/2000 Burgoyne
6,111,559 A 8/2000 Motomura
6,111,560 A 8/2000 May
6,120,588 A 9/2000 Jacobson
6,120,839 A 9/2000 Comiskey
6,144,162 A 11/2000 Smith
6,163,621 A 12/2000 Paik
6,172,798 B1 1/2001 Albert
6,184,969 B1 2/2001 Fergason
6,215,920 B1 4/2001 Whitehead
6,243,055 B1 6/2001 Fergason
6,243,068 B1 6/2001 Evanicky
6,268,843 B1 7/2001 Arakawa
6,276,801 B1 8/2001 Fielding
6,282,311 B1 8/2001 McCarthy
6,282,312 B1 8/2001 McCarthy
6,285,784 B1 9/2001 Spaulding
6,300,932 B1 10/2001 Albert
6,301,393 B1 10/2001 Spaulding
6,323,989 B1 11/2001 Jacobson
6,327,072 B1 12/2001 Comiskey
6,335,983 B1 1/2002 McCarthy
6,381,372 B1 4/2002 Loce
6,414,661 B1 7/2002 Shen
6,428,189 B1 8/2002 Hochstein
6,437,769 B1 8/2002 Kobayashi
6,439,731 B1 8/2002 Johnson
6,448,951 B1 9/2002 Sakaguchi
6,448,955 B1 9/2002 Evanicky
6,470,115 B1 10/2002 Yonekubo
6,483,643 B1 11/2002 Zuchowski
6,520,646 B2 2/2003 Rodriguez
6,590,561 B1 7/2003 Kabel
6,600,467 B1 * 7/2003 Webb ..... G02F 1/133617 345/4
6,608,439 B1 * 8/2003 Sokolik ..... B82Y 20/00 313/504
6,608,614 B1 8/2003 Johnson
6,621,482 B2 9/2003 Fuller
6,631,995 B2 10/2003 Stanton
6,644,832 B2 11/2003 Yoshida
6,654,156 B1 11/2003 Crossland
6,657,607 B1 12/2003 Evanicky
6,680,834 B2 1/2004 Williams
6,683,657 B1 1/2004 Miyawaki
6,728,023 B1 4/2004 Alioshin
6,748,106 B1 6/2004 Bryant
6,753,661 B2 6/2004 Muthu
6,754,384 B1 6/2004 Spaulding
6,775,407 B1 8/2004 Gindele
6,795,585 B1 9/2004 Parada
6,796,658 B2 9/2004 Hubel
6,799,865 B2 * 10/2004 Ellens ..... G02F 1/133603 257/E25.02
6,803,901 B1 10/2004 Numao
6,816,141 B1 11/2004 Fergason
6,817,717 B2 11/2004 Childers
6,822,760 B1 11/2004 Spaulding
6,831,624 B1 12/2004 Harrold
6,831,711 B2 12/2004 Choi
6,863,401 B2 3/2005 Penn
6,864,626 B1 3/2005 Weiss
6,888,663 B2 5/2005 Bourdelais
6,891,672 B2 * 5/2005 Whitehead ..... G03B 21/60 348/E5.139
6,930,737 B2 8/2005 Weindorf

(56) References Cited

U.S. PATENT DOCUMENTS 6,952,195 B2 10/2005 Arakawa
6,980,195 B2 12/2005 Lonoce
6,985,272 B2 1/2006 Bridgwater
7,002,533 B2 2/2006 Sayag
7,018,046 B2 3/2006 Childers
7,036,946 B1 * 5/2006 Mosier ..... G02F 1/133617 349/68
7,052,138 B2 5/2006 Matsui
7,052,152 B2 * 5/2006 Harbers ..... G02F 1/133603 349/71
7,053,881 B2 5/2006 Itoh
7,064,740 B2 6/2006 Daly
7,071,907 B1 7/2006 Duboc, Jr.
7,118,225 B2 10/2006 Penn
7,125,281 B2 10/2006 Sweetland
7,126,254 B2 10/2006 Nanataki
7,133,015 B1 * 11/2006 Yoshida ..... G09G 3/342 345/103
7,175,281 B1 2/2007 Berman
7,230,603 B2 6/2007 Yamamoto
7,370,979 B2 5/2008 Whitehead
7,377,652 B2 5/2008 Whitehead
7,413,307 B2 8/2008 Whitehead
7,419,267 B2 9/2008 Whitehead
7,420,323 B2 9/2008 Krummacher
7,430,022 B2 9/2008 Hekstra
7,465,104 B2 12/2008 Tokui
7,481,562 B2 1/2009 Chua
7,486,854 B2 2/2009 Van Ostrand
7,532,192 B2 5/2009 Feng
7,537,947 B2 5/2009 Smith
7,581,837 B2 9/2009 Whitehead
7,649,594 B2 1/2010 Kim
7,686,493 B2 3/2010 Roshan
7,696,684 B2 4/2010 Weiss
7,703,942 B2 * 4/2010 Narendran ..... H01L 33/507 362/231
7,733,017 B2 6/2010 Shapiro
7,746,423 B2 6/2010 Im
7,751,663 B2 7/2010 Van Ostrand
7,768,023 B2 8/2010 Diana
7,777,945 B2 8/2010 Seetzen
7,800,822 B2 9/2010 Seetzen
7,808,585 B2 * 10/2010 Haga ..... G02B 5/201 349/106
7,845,822 B2 12/2010 Bierhuizen
7,858,409 B2 12/2010 Kessels
7,906,041 B2 * 3/2011 Li ..... C09K 11/7734 252/301.4 F
7,982,812 B2 7/2011 Rho
7,988,311 B2 8/2011 Helbing
8,026,661 B2 9/2011 Weiss
8,035,772 B2 10/2011 Kim
8,059,110 B2 11/2011 Seetzen
8,075,148 B2 12/2011 Nada
8,125,425 B2 2/2012 Seetzen
8,164,820 B2 4/2012 Cho
8,203,785 B2 6/2012 Kindler
8,210,701 B2 7/2012 Igarashi
8,215,815 B2 7/2012 Meir
8,242,679 B2 8/2012 Noh
8,294,168 B2 10/2012 Park
8,531,353 B2 * 9/2013 Heidrich ..... G09G 3/3426 345/4
8,684,546 B2 4/2014 Ninan
8,773,453 B2 7/2014 Ninan
2001/0008395 A1 7/2001 Yamamoto
2001/0035853 A1 11/2001 Hoelen
2002/0050958 A1 5/2002 Matthies
2002/0135553 A1 * 9/2002 Nagai ..... G09G 3/34 345/89
2002/0145685 A1 * 10/2002 Mueller-Mach .. G02F 1/133621 349/61
2002/0159002 A1 10/2002 Chang
2002/0171617 A1 11/2002 Fuller
2003/0015955 A1 * 1/2003 Shiiki ..... C09K 11/7774 313/486
2003/0048393 A1 3/2003 Sayag
2003/0090455 A1 5/2003 Daly
2003/0117546 A1 6/2003 Conner
2003/0151569 A1 8/2003 Lee
2003/0206245 A1 11/2003 Lin
2004/0012551 A1 1/2004 Ishii
2004/0061708 A1 4/2004 Oh
2004/0218388 A1 11/2004 Suzuki
2005/0073495 A1 * 4/2005 Harbers ..... G02F 1/133603 345/102
2005/0083295 A1 4/2005 Daly
2005/0083296 A1 4/2005 Daly
2005/0146258 A1 * 7/2005 Weiss ..... B82Y 20/00 313/110
2005/0162737 A1 7/2005 Whitehead
2005/0184952 A1 * 8/2005 Konno ..... G09G 3/3426 345/102
2005/0269950 A1 12/2005 Giraldo
2006/0056197 A1 3/2006 Robinson
2006/0092183 A1 5/2006 Malmberg
2006/0103589 A1 5/2006 Chua
2006/0109682 A1 5/2006 Ko
2006/0121371 A1 6/2006 Chung
2006/0125745 A1 6/2006 Evanicky
2006/0139289 A1 * 6/2006 Yoshida ..... G09G 3/342 345/98
2006/0221012 A1 10/2006 Ikeda
2006/0221021 A1 10/2006 Hajjar
2006/0221022 A1 10/2006 Hajjar
2006/0227085 A1 10/2006 Boldt
2006/0232969 A1 10/2006 Bogner
2006/0238103 A1 10/2006 Choi
2006/0238723 A1 10/2006 El-Ghoroury
2006/0244367 A1 11/2006 Im
2006/0244712 A1 * 11/2006 Cho ..... G02B 6/0068 345/102
2006/0274226 A1 * 12/2006 Im ..... B82Y 10/00 349/71
2007/0007881 A1 * 1/2007 Kim ..... B82Y 10/00 313/501
2007/0024576 A1 2/2007 Hassan
2007/0029560 A1 2/2007 Su
2007/0035706 A1 2/2007 Margulis
2007/0096141 A1 5/2007 Chen
2007/0126992 A1 6/2007 Penn
2007/0146584 A1 6/2007 Wang
2007/0246734 A1 10/2007 Lee
2007/0247573 A1 10/2007 Ouderkirk
2007/0247833 A1 10/2007 Lee
2007/0268240 A1 11/2007 Lee
2007/0291019 A1 * 12/2007 Jung ..... G02F 1/133621 345/204
2008/0007172 A1 1/2008 Tan
2008/0030449 A1 2/2008 Lee
2008/0074060 A1 3/2008 Ye
2008/0074583 A1 * 3/2008 Li ..... G02F 1/133617 349/71
2008/0136758 A1 6/2008 Ohta
2008/0150879 A1 6/2008 Kang
2008/0158480 A1 * 7/2008 Ii ..... G02F 1/133617 349/71
2008/0170176 A1 * 7/2008 Shen ..... G02F 1/133604 349/64
2008/0172197 A1 7/2008 Skipor
2008/0180466 A1 * 7/2008 Whitehead ..... G09G 3/3426 345/698
2008/0180948 A1 * 7/2008 Yoon ..... C09K 11/0883 362/230
2008/0215279 A1 9/2008 Salsbury
2008/0225520 A1 9/2008 Garbus
2008/0230795 A1 9/2008 Dias
2008/0297031 A1 * 12/2008 Takahashi ..... C09K 11/0883 313/503
2008/0302977 A1 * 12/2008 Yao ..... G02B 6/005 250/461.1

(56) References Cited

U.S. PATENT DOCUMENTS

| | | | | |
|---|---|---|---|---|
| 2009/0034292 | A1 | 2/2009 | Pokrovskiy | |
| 2009/0039448 | A1 | 2/2009 | Chuang | |
| 2009/0059554 | A1 | 3/2009 | Skipor | |
| 2009/0067156 | A1* | 3/2009 | Bonnett | H04N 13/0454 362/97.2 |
| 2009/0080215 | A1* | 3/2009 | Anandan | G02B 6/0036 362/606 |
| 2009/0091689 | A1 | 4/2009 | Rho | |
| 2009/0109517 | A1 | 4/2009 | Cho | |
| 2009/0162011 | A1 | 6/2009 | Coe-Sullivan | |
| 2009/0175868 | A1 | 7/2009 | Ludwig | |
| 2009/0180055 | A1 | 7/2009 | Kim | |
| 2009/0190095 | A1 | 7/2009 | Ellinger | |
| 2009/0194774 | A1 | 8/2009 | Huang | |
| 2009/0196014 | A1 | 8/2009 | Hsiao | |
| 2009/0231831 | A1 | 9/2009 | Hsiao | |
| 2010/0033798 | A1* | 2/2010 | Wang | G02B 26/02 359/290 |
| 2010/0079704 | A1 | 4/2010 | Cho | |
| 2010/0084674 | A1 | 4/2010 | Paetzold | |
| 2010/0102251 | A1 | 4/2010 | Ferrini | |
| 2010/0102340 | A1 | 4/2010 | Ooya | |
| 2010/0117997 | A1 | 5/2010 | Haase | |
| 2010/0123155 | A1 | 5/2010 | Pickett | |
| 2010/0123839 | A1 | 5/2010 | Lu | |
| 2010/0140641 | A1* | 6/2010 | Kinomoto | G02B 6/0023 257/98 |
| 2010/0155749 | A1 | 6/2010 | Chen | |
| 2010/0159248 | A1* | 6/2010 | Jang | C09K 11/025 428/403 |
| 2010/0172138 | A1 | 7/2010 | Richardson | |
| 2010/0177091 | A1 | 7/2010 | Hioki | |
| 2010/0193806 | A1 | 8/2010 | Byun | |
| 2010/0207865 | A1 | 8/2010 | Auld | |
| 2010/0208172 | A1 | 8/2010 | Jang | |
| 2010/0208493 | A1 | 8/2010 | Choi | |
| 2010/0214282 | A1 | 8/2010 | Whitehead | |
| 2010/0246160 | A1 | 9/2010 | Ito | |
| 2010/0283036 | A1 | 11/2010 | Coe-Sullivan | |
| 2010/0283072 | A1 | 11/2010 | Kazlas | |
| 2010/0289819 | A1 | 11/2010 | Singh | |
| 2011/0085168 | A1 | 4/2011 | Phillips | |
| 2011/0122170 | A1 | 5/2011 | Kim | |
| 2011/0176328 | A1* | 7/2011 | Anandan | G02B 6/0036 362/606 |
| 2011/0205251 | A1 | 8/2011 | Auld | |
| 2011/0299011 | A1 | 12/2011 | Weiss | |
| 2011/0312116 | A1 | 12/2011 | Weiss | |
| 2011/0317097 | A1 | 12/2011 | Kim | |
| 2012/0038286 | A1 | 2/2012 | Hasnain | |
| 2012/0050632 | A1 | 3/2012 | Shih | |
| 2012/0062607 | A1 | 3/2012 | Erinjippurath | |
| 2012/0147296 | A1 | 6/2012 | Montgomery | |
| 2012/0154422 | A1 | 6/2012 | Ninan | |
| 2012/0154464 | A1 | 6/2012 | Ninan | |
| 2012/0274882 | A1 | 11/2012 | Jung | |
| 2012/0287381 | A1* | 11/2012 | Li | G02F 1/133617 349/106 |
| 2012/0300465 | A1 | 11/2012 | Chang | |
| 2013/0050293 | A1 | 2/2013 | Feng | |
| 2013/0120678 | A1 | 5/2013 | Chao | |
| 2013/0201661 | A1 | 8/2013 | Mehrle | |
| 2013/0215136 | A1 | 8/2013 | Jiao | |
| 2013/0293596 | A1 | 11/2013 | Atkins | |
| 2013/0335677 | A1 | 12/2013 | You | |
| 2013/0342558 | A1 | 12/2013 | Sasaki | |
| 2015/0300600 | A1* | 10/2015 | Dubrow | B82Y 20/00 362/330 |
| 2016/0201881 | A1* | 7/2016 | Brown | G09G 3/00 362/84 |

FOREIGN PATENT DOCUMENTS

| | | |
|---|---|---|
| CN | 1732717 | 2/2006 |
| CN | 1841471 | 10/2006 |
| CN | 1841487 | 10/2006 |
| CN | 201062757 | 5/2008 |
| CN | 101243557 | 8/2008 |
| CN | 101322247 | 12/2008 |
| CN | 101484841 | 7/2009 |
| EP | 0730371 | 9/1996 |
| EP | 0829747 | 3/1998 |
| EP | 1136874 | 9/2001 |
| EP | 1431653 | 6/2004 |
| EP | 1521235 | 4/2005 |
| EP | 1202244 | 8/2005 |
| EP | 1579733 | 9/2005 |
| EP | 1922763 | 5/2008 |
| EP | 2365384 | 9/2011 |
| JP | 60-54120 | 4/1985 |
| JP | 60-54174 | 4/1985 |
| JP | 62-234133 | 10/1987 |
| JP | 2-78393 | 3/1990 |
| JP | H02-162389 | 6/1990 |
| JP | H13-71111 | 3/1991 |
| JP | 31-98026 | 8/1991 |
| JP | H04-204591 | 7/1992 |
| JP | H07-121120 | 5/1995 |
| JP | 08-334742 | 12/1996 |
| JP | H10-269802 | 10/1998 |
| JP | 11-052412 | 2/1999 |
| JP | 11-064820 | 3/1999 |
| JP | 2000-035576 | 2/2000 |
| JP | 2000-214827 | 8/2000 |
| JP | 2000-275595 | 10/2000 |
| JP | 2001-100689 | 4/2001 |
| JP | 2002-091385 | 3/2002 |
| JP | 2002-099250 | 4/2002 |
| JP | 2002-140338 | 5/2002 |
| JP | 2004-325647 | 11/2004 |
| JP | 2005-258248 | 9/2005 |
| JP | 2006-114909 | 4/2006 |
| JP | 2007-058209 | 3/2007 |
| JP | 2008-507735 | 3/2008 |
| JP | 2008-096547 | 4/2008 |
| JP | 2008-538145 | 10/2008 |
| JP | 2009-251129 | 10/2009 |
| JP | 2009-267239 | 11/2009 |
| JP | 2010-525555 | 7/2010 |
| JP | 2012-500996 | 1/2012 |
| JP | 2012-505435 | 3/2012 |
| JP | 2013-161053 | 8/2013 |
| KR | 10-2005-0021548 | 3/2005 |
| KR | 10-2005-0046816 | 5/2005 |
| KR | 2008-0041780 | 5/2008 |
| KR | 10-2010-0039910 | 4/2010 |
| KR | 2011-0012246 | 2/2011 |
| KR | 2011-0072210 | 6/2011 |
| KR | 2012-0078883 | 7/2012 |
| KR | 2013-0000506 | 1/2013 |
| RU | 2456660 | 7/2012 |
| WO | 91/15843 | 10/1991 |
| WO | 99/19767 | 4/1999 |
| WO | 00/40018 | 7/2000 |
| WO | 2009/101727 | 8/2000 |
| WO | 00/75720 | 12/2000 |
| WO | 01/69584 | 9/2001 |
| WO | 01/69941 | 9/2001 |
| WO | 02/03687 | 1/2002 |
| WO | 02/069030 | 9/2002 |
| WO | 02/079862 | 10/2002 |
| WO | 03/021340 | 3/2003 |
| WO | 03/058726 | 7/2003 |
| WO | 03-077013 | 9/2003 |
| WO | 2004/010406 | 1/2004 |
| WO | 2004/031844 | 4/2004 |
| WO | 2004/032523 | 4/2004 |
| WO | 2004/060024 | 7/2004 |
| WO | 2005/101309 | 10/2005 |
| WO | 2006/010244 | 2/2006 |

(56) References Cited

FOREIGN PATENT DOCUMENTS

| | | | |
|---|---|---|---|
| WO | 2006/107720 | 10/2006 | |
| WO | 2007/020556 | 2/2007 | |
| WO | 2007/114918 | 10/2007 | |
| WO | WO 2008094153 A1 * | 8/2008 | ..... G09G 3/3426 |
| WO | 2009/041574 | 4/2009 | |
| WO | 2009/041594 | 4/2009 | |
| WO | 2009/078426 | 6/2009 | |
| WO | 2010/058162 | 5/2010 | |
| WO | 2011/031802 | 3/2011 | |
| WO | 2012/082825 | 6/2012 | |

OTHER PUBLICATIONS

Endo, N. "Transparent LCD Devices", Toshiba Technology Presentation Collection, Apr. 4, 1996, p. 175, Japan.

Funamoto, et al "High-Picture-Quality Technique for LCD Televisions: LCD-A1", FMC6-4 (Late-News Paper) pp. 1157-1158 (2000).

Funamoto, T. et al "Technology for LCD Televisions with High Image Quality" Matsushita Technical Journal, vol. 46, No. 3, Jun. 2000.

Mitsuhashi, Y. (Sharp Corporation Electronic Components Group Display Div.) "Recent Developments in LED Back Light Devices", Television Technology Institute Reports, Feb. 25, 1986, pp. 15-20, Japan.

Mitsuhashi, Y. "Regarding LED Backlight Systems for LCD's" Tech. Rep. Inst. Television Eng. Feb. 25, 1986.

Ohara, A. "Backlight for Liquid Crystal Displays", Special Section: Display Materials and Their Applications, J. Illum. Engineering Inst. Japan, vol. 73, No. 12, 1989, pp. 46-52.

Spaulding, Kevin E. et al "Using a Residual Image to Extend the Color Gamut and Dynamic Range of an sRGB Image", Kodak Professional Technical Overview, Eastman Kodak Company, 2003, pp. 1-9.

Suzuki, Y. "Liquid Crystal Applications", Tech. Rep. Inst. Television Engineering, 1983 SID International Symposium Session VI, Jul. 28, 1983.

Ward, Greg, "A Wide Field, High Dynamic Range" Stereographic Viewer, Apr. 2002.

Seetzen, H. "A High Dynamic Range Display Using Low and High Resolution Modulators" SID 03 Digst, 2003, pp. 1450-1453.

Spaulding, Kevin E. et al. "Extending the Color Gamut and Dynamic Range of an sRGB Image Using a Residual Image", Color Research and Application, vol. 28, No. 4, Aug. 2003, pp. 251-266.

Green, Kate, "How Quantum Dots Will Make LCDs Better", Dec. 9, 2009, QD Vision.

NanocoTechnologies "The Future of Cadmium Free QD Display Technology" Apr. 2011.

Nanosys and LG Close to Bringing Quantun Dot Technology to LCD Displays, Nov. 4, 2010.

Quantum Dot LCD Hdtv, Dec. 31, 2009.

* cited by examiner

LOCALLY DIMMED QUANTUM DOT DISPLAY

CROSS REFERENCE TO RELATED APPLICATIONS

This application is a continuation of U.S. patent application Ser. No. 14/749,195, filed on Jun. 24, 2015, which is a continuation of U.S. patent application Ser. No. 14/215,856, filed on Mar. 17, 2014, now U.S. Pat. No. 9,099,046, issued on Aug. 4, 2015, which is a continuation of U.S. patent application Ser. No. 12/707,276, filed on Feb. 17, 2010, which claims priority to U.S. Provisional Patent Application No. 61/154,866, filed Feb. 24, 2009, all of which are hereby incorporated by reference in their entireties.

TECHNICAL FIELD

This technology relates to dual modulator displays. Particular embodiments provide apparatus for providing light source modulation in dual modulator displays.

BACKGROUND

Dual modulator displays are described in PCT Patent Application Publication Nos. WO02/069030, WO03/077013, WO2006/010244 and WO2008/092276 (collectively, the "Dual Modulator Display Applications") which are hereby incorporated herein by reference. In some embodiments, such displays comprise a light source modulation layer and a display modulation layer. The light source modulation layer may be driven to produce a relatively low resolution representation of an image which is subsequently provided to the relatively high resolution display modulation layer. The low resolution representation generated by the light source modulation layer may be further modulated by the higher resolution display modulation layer to provide an output image which is ultimately viewed by the observer.

In some embodiments, the light source modulation layer may comprise an array of modulated light sources, such as light emitting diodes (LEDs), for example. Because the light source modulation layer typically illuminates the display modulation layer, the light source modulation layer may be referred to as a backlight or backlight modulation layer. In general, however, it is not required that the light source modulation layer be located behind the display modulation layer. The display modulation layer, which may be positioned and/or aligned to receive light from the light source modulation layer, may comprise a liquid crystal display (LCD) panel, for example.

Modulation at the light source modulation layer causes a spatially varying light pattern to be received at the display modulation layer. The brightness of the pixels on the display modulation layer is therefore affected by the variable localized brightness of the light received at the display modulation layer from the light source modulation layer. Determining the driving values for the display modulation layer may comprise using the driving values for the light source modulation layer to estimate the expected luminance pattern at the display modulation layer and then using this expected luminance to derive driving values for the display modulation layer.

The light emitted by the light source modulation layer may be relatively broad bandwidth light relative to the visible spectrum. Where broad bandwidth light is used to illuminate the display modulation layer, the resulting gamut of the display may be restricted since the wide bandwidth light may be unable to produce highly saturated colors. In other displays, the light source modulation layer may comprise a plurality of relatively narrow band light sources (e.g. red, green and blue (RGB) LEDs). While using narrowband light sources in the light source modulation layer may increase the gamut of the display by providing the ability to output more highly saturated colors, the narrow bandwidth sources can cause metameric issues, where a color generated by the display may produce a color match (e.g. to a sample color) for one observer, but the same display color will not produce a color match for a different observer.

There are general desires to maximize or improve the color gamut of displays and to minimize or reduce metameric issues.

Dual modulator displays may also suffer from parallax issues when viewers are located off of the optical axis of the display. Such parallax issues may result, for example, because the degree to which different elements of the light source modulation layer illuminate corresponding elements of the display modulation layer vary with viewing angle. Accordingly, when a viewer is located off of the optical axis of the display, the viewer may see visible artefacts attributable to parallax.

There is a general desire to minimize or reduce parallax issues in dual modulator displays.

BRIEF DESCRIPTION OF DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Particular embodiments of the invention provide dual modulator displays wherein a phosphorescent plate or the like comprising one or more phosphor materials is interposed in the optical path between a light source modulation layer and a display modulation layer. Spatially modulated light output from the light source modulation layer impinges on the phosphorescent plate and excites corresponding regions of the phosphorescent plate which in turn emit light having different spectral characteristics than the light output from the light source modulation layer. Light emitted from the phosphorescent plate is received and further modulated by the display modulation layer to provide the ultimate display output.

Advantageously, the characteristics (e.g. spectral and/or luminosity characteristics) of the light output by the phosphorescent plate may be more easily controlled and/or predicted than corresponding characteristics of the light source modulation layer. The characteristics of the phosphorescent plate may be selected to to maximize or improve the color gamut of the display and/or to minimize or reduce metameric issues associated with the display, for example. The phosphorescent plate may be located in positions contiguous with, or closely spaced apart from, the display modulation layer which may minimize or reduce parallax issues associated with the display. The phosphorescent plate may also diffuse light received at the display modulation layer, which may in turn reduce or eliminate the need for a diffuser or other optics between the light source and display modulation layers.

Figure 1A:
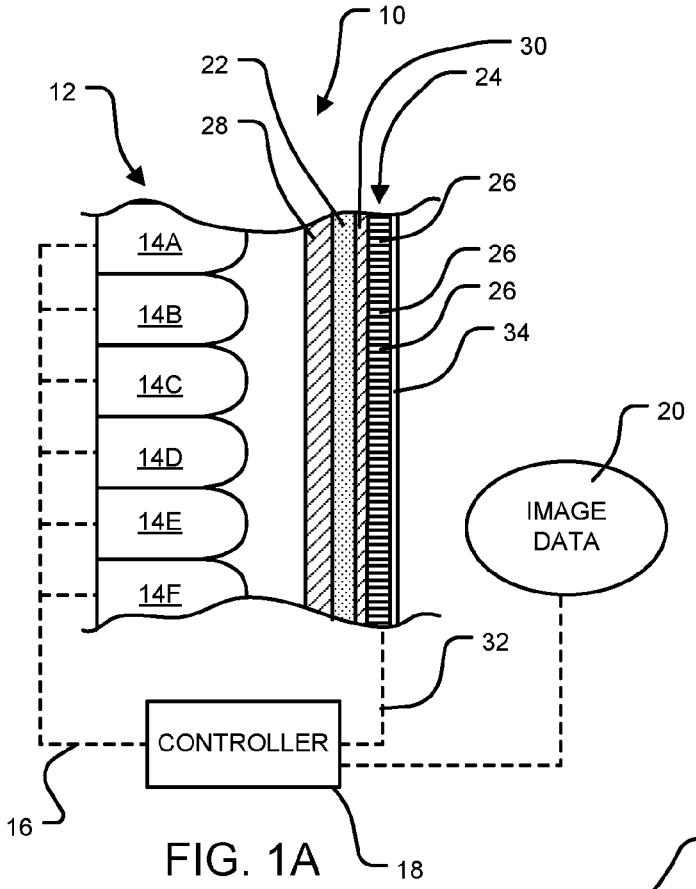
FIG. 1A is a partial cross-section of a dual modulator display according to a particular embodiment of the invention.

FIG. 1A is a partial cross-sectional diagram of a dual modulator display 10 according to a particular embodiment. Display 10 may be similar in many respects to the displays disclosed in the Dual Modulator Display Applications. For clarity, some features of display 10 not germane to the present invention are not explicitly shown in FIG. 1A. Display 10 comprises a phosphorescent plate 22 located in the optical path between light source modulation layer 12 and display modulation layer 24. Phosphorescent plate 22 comprises one or more phosphorescent materials which are energized by spatially modulated light received from light source modulation layer 12. Phosphorescent plate 22 in turn provides spatially modulated light to display modulation layer 24. Display modulator 24 further modulates the light received from phosphorescent plate 22 to provide the output of display 10. In currently preferred embodiments, the spatial modulation provided by display modulation layer 24 has a higher resolution than the spatial modulation provided by light source modulation layer 12, although this is not necessary.

Display 10 comprises a controller 18. Controller 18 may comprise any combination of hardware and software capable of operating as described herein. By way of non-limiting example, controller 18 may comprise one or more suitably programmed data processors, hard-wired or configurable logic elements, memory and interface hardware and/or software. The data processors of controller 18 may comprise one or more programmable computers, one or more embedded processors or the like. As explained in more detail below, controller 18 may control the operation of light source modulation layer 12 using drive signals 16 and display modulation layer 24 using drive signals 32.

In the illustrated embodiment, light source modulation layer 12 is implemented by an array of individually addressable LEDs 14A, 14B, 14C, 14D, 14E, 14F (collectively, LEDs 14). In other embodiments, LEDs 14 may be replaced with or supplemented with lasers. As described in the Dual Modulator Display Applications, light source modulator 12 may be implemented using other components. By way of non-limiting example, light source modulator 12 may be implemented by:

- an array of controllable light sources of a type different than LEDs;
- one or more light sources and a light modulator disposed to spatially modulate the intensity of the light from the one or more light sources; and
- some combination of these.

Light source modulation layer 12 outputs spatially modulated light in response to driving signals 16 received from controller 18. Light source modulation layer 12 may emit spatially modulated light with central wavelengths at or near the blue/violet end of the visible spectrum. Light source modulation layer 12 may additionally or alternatively emit ultraviolet light (i.e. with central wavelengths below those of the visible spectrum). At these wavelengths, the photons emitted by light source modulation layer 12 have energies that are relatively high (compared to photons in the visible spectrum). Consequently, when excited, the one or more phosphorescent materials on phosphorescent plate 22 can emit light having desired spectral characteristics in the visible spectrum. In some example embodiments where light source modulation layer 12 emits visible light, the spatially modulated light emitted by light source modulation layer 12 includes light having a central wavelength less than 490 nm. In other embodiments, this central wavelength is less than 420 nm. In other embodiments, light source modulation layer 12 may emit ultraviolet light having central wavelengths less than 400 nm.

The spatially modulated light emitted by light source modulation layer 12 is received on phosphorescent plate 22. The one or more phosphorescent materials of phosphorescent plate 22 are energized and in turn emit spatially modulated light that is received at display modulation layer 24. As discussed in more detail below, some of the light from light source modulation layer 12 may also be transmitted by phosphorescent plate 22 to display modulation layer 24.

Figure 1B:
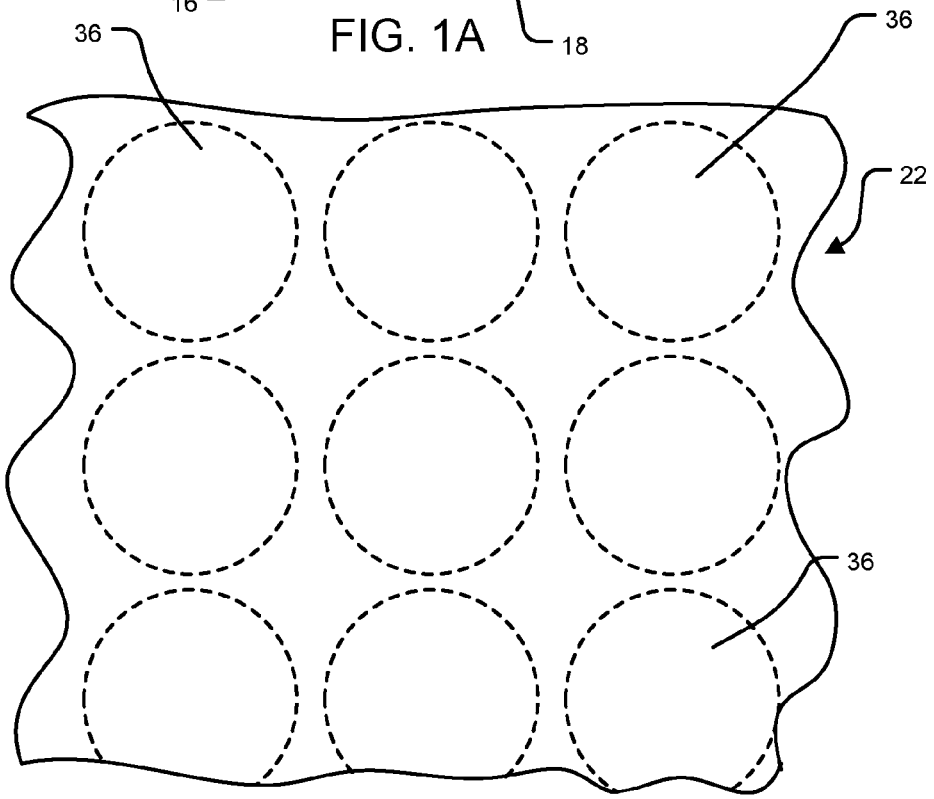
FIG. 1B shows a portion of a phosphorescent plate suitable for use with the FIG. 1A display illuminated by light from the light source modulation layer.
Figure 1C:
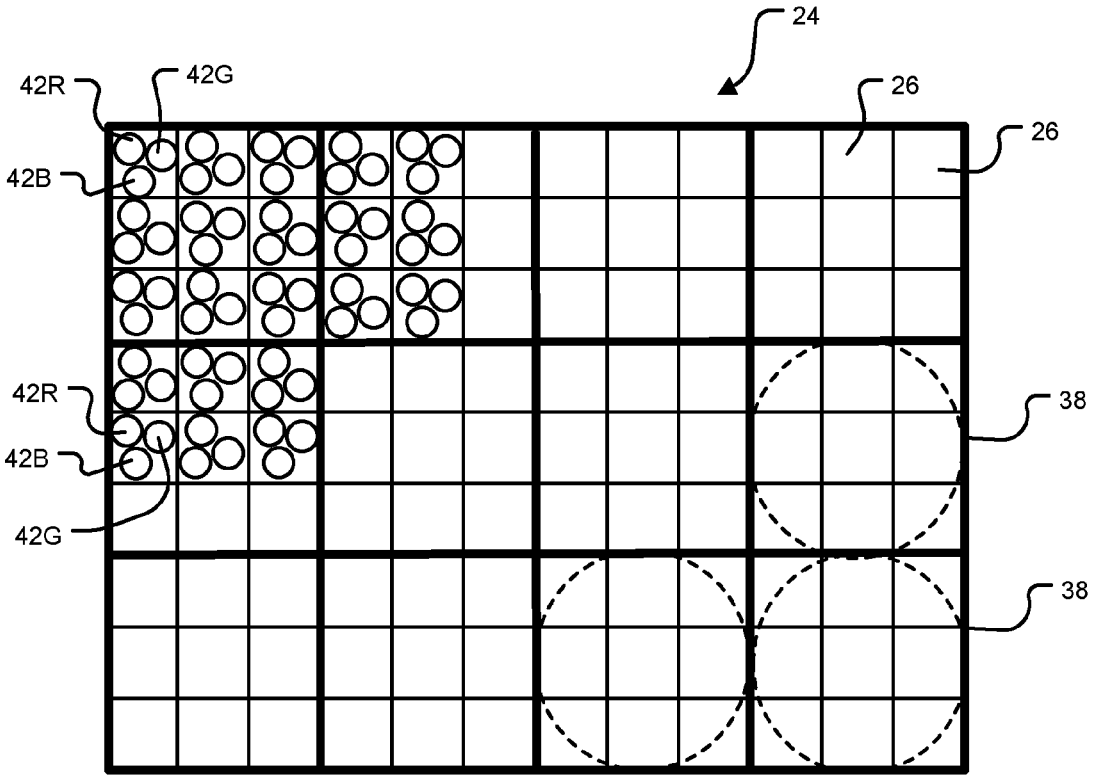
FIG. 1C illustrates a possible relationship between the modulation elements of the light source modulation layer (and their corresponding the phosphorescent plate regions) and the pixels in the display modulation layer of the FIG. 1A display.

A portion of display modulation layer 24 is shown in FIG. 1C. Display modulation layer 24 further modulates the light received from phosphorescent plate 22 to provide the ultimate image output of display 10. In the illustrated embodiment, display modulation layer 24 comprises a LCD panel having a plurality of individually addressable pixels 26, each pixel 26 having a plurality of individually addressable sub-pixels 42 (e.g. red, green and blue (RGB) sub-pixels 42R, 42G, 42B). Each sub-pixel 42 may comprise a corresponding color filter (e.g. a red, green or blue color filter) and controllable liquid crystal element (not shown) which respectively filter and attenuate the light output as is known in the art. For clarity, FIG. 1C only shows sub-pixels 42R, 42G, 42B for some pixels 26. Various constructions of LCD panels known in the art include different arrangements of colored sub-pixels 42 and are suitable for use in this invention.

In the illustrated embodiment, display 10 comprises an optional optical system 28 interposed on the optical path between light source modulation layer 12 and phosphorescent plate 22. Optical system 28 may serve to provide smoothly spatially varying and/or sufficiently diffuse light on phosphorescent plate 22 and may serve to image light from individual elements (e.g. LEDs 14) of light source modulation layer 12 onto corresponding regions 36 of phosphorescent plate 22. By way of non-limiting example, optical system 28 may comprise one or more of imaging lenses, collimators, diffusers, internally reflecting light guides and/or open space. In some embodiments, optical system 28 is not necessary.

In particular embodiments, phosphorescent plate 22 may be contiguous with, or closely spaced apart from, display modulation layer 24. In particular embodiments, the spacing between phosphorescent plate 22 and display modulation layer 24 is less than five times the minimum dimension of pixels 26 of display modulation layer 24. In other embodiments, this spacing is less than twice the minimum dimension of pixels 26. The contiguous or closely spaced nature of phosphorescent plate 22 and display modulation layer 24 may serve to minimize or reduce parallax issues, since the light modulated by display modulation layer 24 originates from locations contiguous or closely spaced from display modulation layer 24.

As shown in FIG. 1A, display 10 may additionally or alternatively comprise an optional optical system 30 located in the optical path between phosphorescent plate 22 and display modulation layer 24. Optical system 30 may serve to provide smoothly spatially varying and/or sufficiently diffuse light on display modulation layer 24 and may serve to image light from individual regions 36 of phosphorescent plate 22 onto corresponding regions 38 of display modulation layer 24. Optical system 30 may also help to overcome localized variances in the phosphorescent materials of phosphorescent plate 22. By way of non-limiting example, optical system 30 may comprise one or more of imaging lenses, collimators, diffusers, internally reflecting light guides and/or open space. In some embodiments, optical system 30 is not necessary.

In the illustrated embodiment, display 10 also comprises an optional diffuser 34 on the output side of display modulation layer 24 for scattering the outgoing light so that a viewer can see the light output from display 10 from a wider viewing angle.

Phosphorescent plate 22 may comprise any of a variety of well known materials that are excited (and emit light) in response to receiving light at the wavelength emitted by light source modulation layer 12. By way of non-limiting example, where the light emitted by light source modulation layer 12 is blue visible light (e.g. with central wavelengths of approximately 400 nm-490 nm), the materials in phosphorescent plate 22 may comprise inorganic light-emitting materials, such as: yttrium aluminum garnet (YAG); terbium aluminum garnet (TAG); sulfides, such as MGa2S2 and ZnS; aluminates, such as SrAl2O4; halides, such as Ca10 (PO4)6Cl2; and/or rare earth borates, such as YBO4. To provide light-emitting excitation effects, these compounds may be mixed with trace elements of activation metal(s)—e.g. cerium (Ce), europium (Eu), terbium (Tb), bismuth (Bi), or manganese (Mn). Phosphorescent plate 22 may comprise the same phosphorescent materials used for cathode ray tube (CRT) color displays. Phosphorescent plate 22 may additionally or alternatively comprise organic light-emitting materials, such as organic pigments or organic dyes for which the light emission characteristics may be tailored by the number and the positions of their functional groups and the addition or removal of trace element(s).

In some embodiments of the FIG. 1A display 10, the material(s) of phosphorescent plate 22 may be selected such that phosphorescent plate 22 emits light having a broadband spectral characteristic. For example, in some embodiments, the light emitted by phosphorescent plate 22 may have a spectral distribution that includes more than 75% of the visible light spectrum. Such broadband spectral distributions may minimize metameric issues and provide display 10 with good color matching characteristics. In other embodiments of the FIG. 1A display 10, the material(s) of phosphorescent plate 22 may be selected such that phosphorescent plate 22 emits light having a multi-modal spectral distributions—i.e. with a plurality of spectral peaks. Material(s) which provide multi-modal spectral distributions may comprise suitable combinations of constituent materials, each of which has a relatively narrow emission spectrum. Such multi-modal spectral distributions may provide display 10 with a relatively wide color gamut. Other embodiments, the light emitted by phosphorescent plate 22 may have a relatively broadband spectral distribution (e.g. that includes more than 50% of the visible light spectrum), but may also incorporate multi-mode peaks to achieve some desirable combination of minimizing (or reducing) metamerism and maximizing (or increasing) color gamut.

Phosphorescent plate 22 may also transmit some light emitted by light source modulation layer 12. For example, where LEDs 14 of light source modulation layer 12 emit blue light in the visible spectrum, such blue light may be transmitted through phosphorescent plate 22 and may form part of the visible light spectrum received at display modulation layer 24. References in this description to phosphorescent plate 22 emitting or providing light should be understood to include the possibility that some of the light emitted from or provided by phosphorescent plate 22 may actually be transmitted therethrough from light source modulation layer 12.

FIG. 1B shows a portion of phosphorescent plate 22 according to a particular embodiment suitable for use with display 10 of FIG. 1A. Phosphorescent plate 22 comprises a plurality of regions 36 shown in dotted outline. Regions 36 are shown as being circularly shaped, but this is not necessary. Each one of the modulation elements (e.g. LEDs 14) of light source modulation layer 12 principally illuminates a corresponding region 36 on phosphorescent plate 22.

Regions 36 illustrated in FIG. 1B are schematic in nature. Light from a particular LED 14 may spread outside its corresponding phosphorescent plate region 36 and may overlap light from a neighboring LED 14 on phosphorescent plate 22. Thus, while each phosphorescent plate region 36 is principally illuminated by a corresponding modulation element (e.g. LED 14) of light source modulation layer 12, each phosphorescent plate region 36 may also receive light from neighboring modulation elements (e.g. LEDs 14). Such spatially modulated and overlapping light on phosphor plate 22 may help to provide smoothly spatially varying light at phosphorescent plate 22.

In general, the characteristics of the light emitted from a particular phosphorescent plate region 36 will depend on the light received from LED(s) 14 (or other modulation element(s)) of light source modulation layer 12—i.e. relatively intense illumination of a particular region 36 of phosphorescent plate 22 will produce correspondingly greater excitation of the materials of phosphorescent plate 22 such that the particular region 36 of phosphorescent plate 22 will emit relatively more light.

FIG. 1C illustrates a possible relationship between regions 36 of phosphorescent plate 22 and pixels 26 in display modulation layer 24. Light emitted from a particular region 36 of phosphorescent plate 22 principally illuminates a corresponding region 38 of display modulation layer 24. In FIG. 1B, display modulation layer regions 38 which are illuminated principally by a corresponding region 36 of phosphorescent plate 22 are shown in thicker lines. Light from a particular phosphorescent plate region 36 may spread outside its corresponding display modulation layer region 38 and may overlap light from its neighboring phosphorescent plate regions 36. Thus, while each display modulation layer region 38 is principally illuminated by a corresponding phosphorescent plate region 36 of phosphorescent plate 22, each display modulation layer region 38 may also receive light from neighboring phosphorescent plate regions 36. Such overlapping light may help to provide smoothly spatially varying light at display modulation layer 24. Display modulation layer regions 38 are shown as being rectangularly shaped (3×3 pixels), but this is not necessary. The receipt of light from particular phosphorescent plate regions 36 at display modulation layer region 38 is shown schematically in FIG. 1C by dotted outline (representing phosphorescent plate regions 36). For clarity, FIG. 1C only shows this dotted outline in some of display modulation layer regions 38.

Because the resolution of display modulation layer 24 is greater than that of light source modulation layer 12, each display modulation layer region 38 comprises a plurality of pixels 26. For example, in the illustrated embodiment, each display modulation layer region 38 comprises nine pixels 26. In other embodiments, each display modulation layer region 38 may comprise a different number of pixels 26. The size of pixels 26 may be selected to provide display 10 with a desired overall resolution.

The Dual Modulator Display Applications describe how, in some embodiments, light from individual elements of the light source modulation layer may overlap when received at the display modulation layer to provide smoothly spatially varying light at the display modulation layer or, in other embodiments, light from individual elements of the light source modulation layer may be channeled by reflective walled channels to corresponding regions of the display modulation layer.

In a similar manner, in some embodiments, light from individual modulation elements (e.g. LEDs 14) of light source modulation layer 12 may overlap at phosphorescent plate 22 to provide smoothly spatially varying light at phosphorescent plate 22 and/or light from corresponding phosphorescent plate regions 36 may overlap at display modulation layer 24 to provide smoothly spatially varying light at display modulation layer 24. The spread of light from a modulation element (e.g. LED 14) of light source modulation layer 12 may be referred to as the point spread function (PSF) of that modulation element. This point spread function may be influenced by phosphorescent plate 22 interposed between light source modulation layer 12 and display modulation layer 24. In embodiments where light from individual modulation elements of display modulation layer 12 is permitted to spread, each region 36 of phosphorescent plate 22 shown in dotted outline in FIG. 1B should be understood to be a representative region 36 which receives the peak illumination from a corresponding LED 14 of light source modulation layer 12, but that the light from the corresponding LED 14 spreads outside the illustrated region 36. Similarly, each region 38 of display modulation layer 24 shown in thick lines in FIG. 1C should be understood to be a representative region 38 which receives the peak illumination from a corresponding region 36 of phosphorescent plate 22, but that the light from the corresponding region 36 of phosphorescent plate 22 spreads outside the illustrated display modulation layer region 38. References in this description to a light source which principally illuminates a region 36, 38 should be understood to include light which may spread outside this region.

In other embodiments, light from individual modulation elements (e.g. LEDs 14) of light source modulation layer 12 may be channelled by reflective walled channels (which may be part of optional optical system 28 and/or optional optical system 30) to corresponding regions 36 of phosphorescent plate 22 and ultimately to corresponding regions 38 at display modulation layer 24. While light may still extend outside regions 36, 38 in such embodiments, the extension of light outside regions 36, 38 may be reduced (relative to embodiments where this light is permitted to spread) and there may be relatively rapid changes in illumination at the boundaries between regions 36, 38.

In operation, controller 18 determines an operational value for each LED 14 (or other modulation element) of light source modulation layer 12 and outputs these drive values to LEDs 14 as drive signals 16. Drive signals 16 may be provided to LEDs 14 via suitable drive electronics (not shown). As explained in the Dual Modulator Display Applications, drive signals 16 may be determined based at least in part on image data 20. In the illustrated embodiment, light from each of LEDs 14 principally excites a corresponding region 36 of phosphorescent plate 22. Controller 18 also determines drive values for each modulation element (e.g. sub-pixels 42) of display modulation layer 24 and outputs these drive values as drive signals 32. Drive signals 32 may be provided to display modulation layer 24 via suitable drive electronics (not shown). Drive signals 32 may be determined based at least in part on one or more of: image data 20; driving signals 16; the expected light output (e.g. point spread function) for LEDs 14 of light source modulation layer 12; and the expected light output of the corresponding regions of phosphorescent plate 22. Drive signals 32 which control higher resolution display modulation layer 24 may compensate for the spatial variation of the light emitted from light source modulation layer 12 and the corresponding regions of phosphorescent plate 22.

The determination of drive signals 16 for light source modulation layer 12 and drive signals 32 for display modulation layer 24 may be similar to any of the processes described in the Dual Modulator Display Applications, except that the expected light received at display modulation layer 24 (i.e. the effective luminance at display modulation layer 24) may be adjusted to incorporate the expected response of the light output from phosphorescent plate 22. It will be appreciated that the expected light output response of phosphorescent layer 22 may be predicted by a transfer function model which relates the expected light output of phosphorescent layer 22 to the light received at phosphorescent layer 22. In some embodiments, for computational purposes, the expected light output response (e.g. transfer function) of phosphorescent plate 22 interposed between light source modulation layer 12 and display modulation layer 24 may be integrated into the point spread function of LEDs 14. In such embodiments, any of the techniques described in the Dual Modulator Display Applications may be used to determine drive signals 16, 32. By way of non-limiting example, any or all of the resolution reduction, point spread function decomposition, 8-bit segmentation and/or interpolation techniques described in PCT Patent Application Publication No. WO2006/010244 for determining the effective luminance at display modulation layer 24 may be used by modifying the point spread function of LEDs 14 to incorporate the expected light output response of phosphorescent layer 22.

Figure 1D:
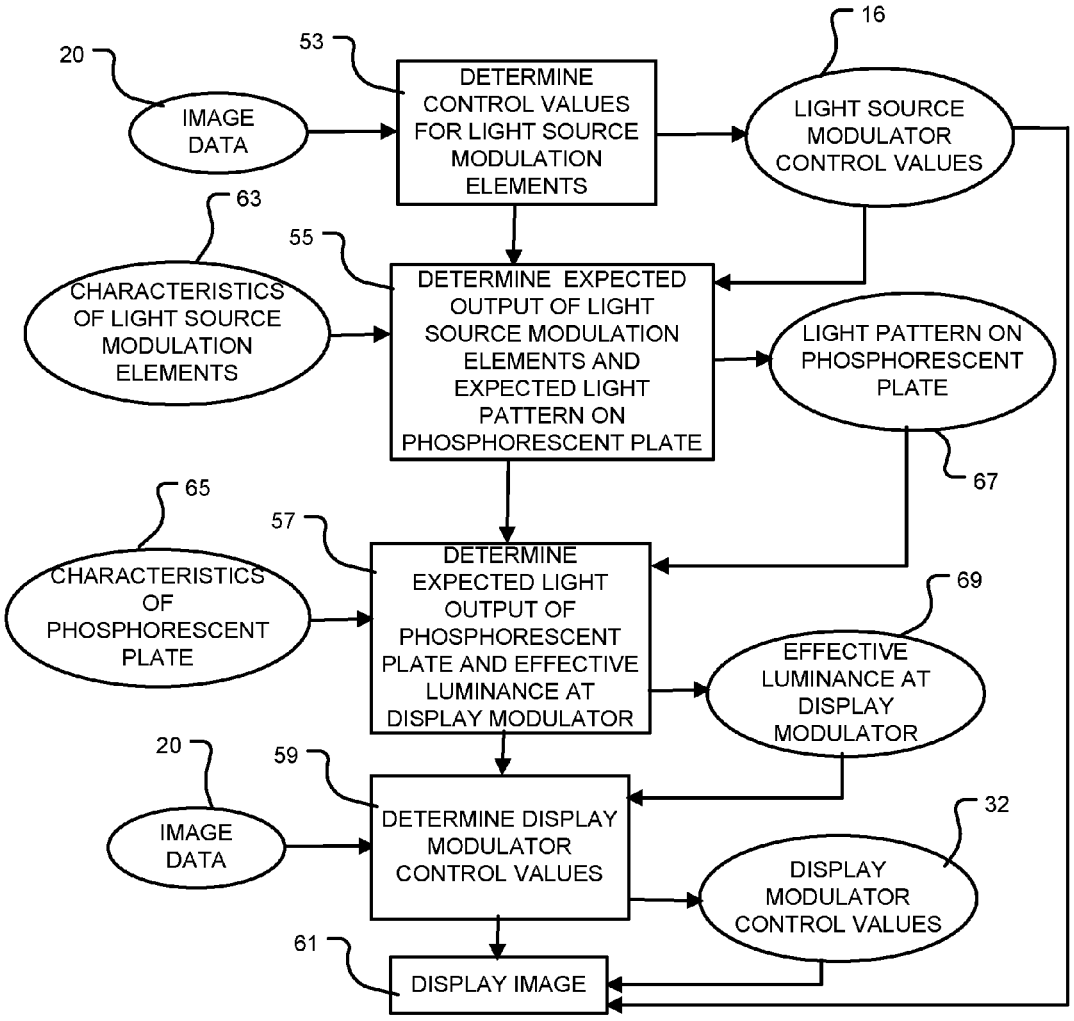
FIG. 1D depicts a method for displaying an image using the FIG. 1A dual modulator display according to an example embodiment.

FIG. 1D depicts a method 51 for displaying an image on display 10 according to an example embodiment. Method 51 may be performed in whole or in part by controller 18. Method 51 comprises determining drive signals 16 for light source modulation layer 12 and determining drive signals 32 for light source modulation layer 24 and using drive signals 16, 32 to display an image in block 61. Method 51 begins in block 53 which involves using image data 20 to determine control values 16 for light source modulation layer 12. The block 53 techniques for determining modulation layer drive values 16 using image data 20 are known to those skilled in the art and, by way of non-limiting example, may include, nearest neighbor interpolation techniques which may be based on factors such as intensity and color.

Method 51 then proceeds to block 55 which involves estimating the output of light source modulation elements (e.g. LEDs 14) and the corresponding light pattern 67 received at phosphorescent plate 22. To determine light pattern 67 received at phosphorescent plate 22, block 55 may incorporate light source modulation layer control values 16 and the response characteristics 65 of the light source modulation elements (e.g. LEDs 14). Response characteristics 65 of LEDs 14 may comprise their point spread functions.

Method 51 then proceeds to block 57, which involves using the expected light pattern 67 on phosphorescent plate 22 together with the phosphorescent plate response characteristics 65 to estimate the expected light output of phosphorescent plate 22 and the corresponding effective luminance 69 at display modulation layer 24. The expected light output of phosphorescent plate 22 and the corresponding effective luminance 69 at display modulation layer 24 represent a second spatially varying light pattern (i.e. where the first spatially varying light pattern comprises the light output from light source modulation layer 12 corresponding to the light pattern 67 received at phosphorescent plate 22). Response characteristics 65 of phosphorescent plate may comprise a transfer function model or the like which describes a relationship between the light received at phosphorescent plate 22 and the light output from phosphorescent plate 22. Since the light pattern 67 received at phosphor plate 22 is spatially varying, the block 57 process of determining the effective luminance 69 at display modulation layer 24 may involve notionally breaking phosphorescent plate 22 into a plurality of spatially distinct regions and determining the contribution of each such region to effective display modulation layer luminance 69. The contribution of each such phosphorescent plate region to effective display modulation layer luminance 69 may be similar to the point spread functions of LEDs 14 and their contribution to the light pattern 67 received at phosphor plate 22. In some embodiments, the notional regions of phosphorescent plate 22 may correspond to regions 36 principally illuminate by corresponding LEDs 14 (FIG. 1B), but this is not necessary. In other embodiments, other phosphor plate regions may be used.

In some embodiments, blocks 55 and 57 may be combined to estimate effective display modulation layer luminance 69 by incorporating phosphorescent plate characteristics 65 into the characteristics 63 of light source modulation elements (e.g. LEDs 14). For example, the transfer function response of phosphorescent plate 22 may be incorporated into the point spread function of LEDs 14. In such embodiments, block 55 and 57 may be replaced by a single block where effective display modulation layer luminance 69 is determined directly from light source modulator control values 16 together with the modified point spread function of LEDs 14. In some embodiments, blocks 55 and/or 57 and/or the combination of blocks 55 and 57 may comprise using techniques for reducing the computational expense associated with these procedures, such as those techniques described in PCT patent publication No. WO2006/010244. By way of non-limiting example, any or all of the resolution reduction, point spread function decomposition, 8-bit segmentation and/or interpolation techniques may be used to determine effective display modulation layer luminance 69.

After estimating effective display modulation layer luminance 69, method 51 proceeds to block 59 which involves determining display modulator control values 32. The block 59 determination may be based at least in part on image data 20 together with the estimated effective display modulation layer luminance 69. Block 59 may involve dividing image data 20 by effective luminance pattern 69 to obtain raw modulation data for light source modulation layer 24. In some cases, block 59 may also involve modification of this raw modulation data to address issues such as non-linearities or other issues which may cause artefacts to thereby obtain display modulator control values 32. Such modification techniques may be known to those skilled in the art and may comprise, by way of non-limiting example, scaling, gamma correcting, value replacement operations etc.

Method 51 then proceeds to block 61 which involves using light source modulator control values 16 to drive light source modulation elements (e.g. LEDs 14) and display modulator control values 32 to drive the elements of display modulation layer 24 to thereby display the image. The light output from display modulation layer 24 represents a third spatially varying light pattern (i.e. where the first spatially varying light pattern comprises the light output from light source modulation layer 12 corresponding to the light pattern 67 received at phosphorescent plate 22 and the second spatially varying light pattern comprises the light emitted from phosphorescent plate 22 corresponding to the effective luminance received at display modulation layer 24).

Phosphorescent plate response characteristics 65 may be non-linear or may be different for different phosphorescent materials used in plate 22. In addition, phosphorescent plate response characteristics 65 may vary over time as plate 22 ages and such long term phosphorescent plate response characteristics 65 may be different for different phosphorescent materials used in plate 22. Method 51 may incorporate calibration techniques for response characteristics 65, material dependant response characteristics 65 and/or time varying models within response characteristics 65 to accommodate these issues.

In some embodiments, it is desirable to provide smoothly spatially varying light at display modulation layer 24 to avoid artefacts which may be created by strong spatial variance between adjacent modulation elements (e.g. LEDs 14) of light source modulator 12. To obtain smoothly spatially varying light at the display modulation layer, some dual modulator displays provide a relatively large optical path length between the light source modulation layer and the display modulation layer and/or incorporate a diffuser in the optical path between the light source modulation layer and the display modulation layer. A drawback with providing a large optical path length between the light source modulation layer and the display modulation layer in prior art dual modulator displays is that the large optical path length contributes to parallax issues. This drawback may be mitigated in display 10, as discussed above, by positioning phosphorescent plate 22 contiguous with, or closely spaced apart from, display modulation layer 24 to minimize or reduce parallax issues. Such positioning of phosphorescent plate 22 may permit light source modulation layer 12 to be spaced relatively far apart from display modulation layer 24 (thereby achieving smooth variance between light from adjacent LEDs 14 at phosphorescent plate 22) without suffering from the corresponding parallax issues associated with this spacing.

Phosphorescent plate 22 may also tend to diffuse light. For example, phosphorescent plate 22 may comprise materials which tend to diffuse the light emitted therefrom and/or transmitted therethrough. Additionally or alternatively, phosphorescent plate 22 may be provided with a surface profile (e.g. a multi-faceted surface profile) which tends to diffuse the light emitted therefrom and/or transmitted therethrough. In some embodiments, phosphorescent plate 22 may comprise a diffusing material or a diffusing surface profile at locations relatively close to light source modulation layer 12, so as to diffuse light from light source modulation layer 12 (i.e. prior to spectral conversion by the phosphorescent material of plate 22). Provision of phosphorescent plate 22 in the optical path between light source modulation layer 12 and display modulation layer 24 may eliminate the need for an additional diffuser.

Figure 2A:
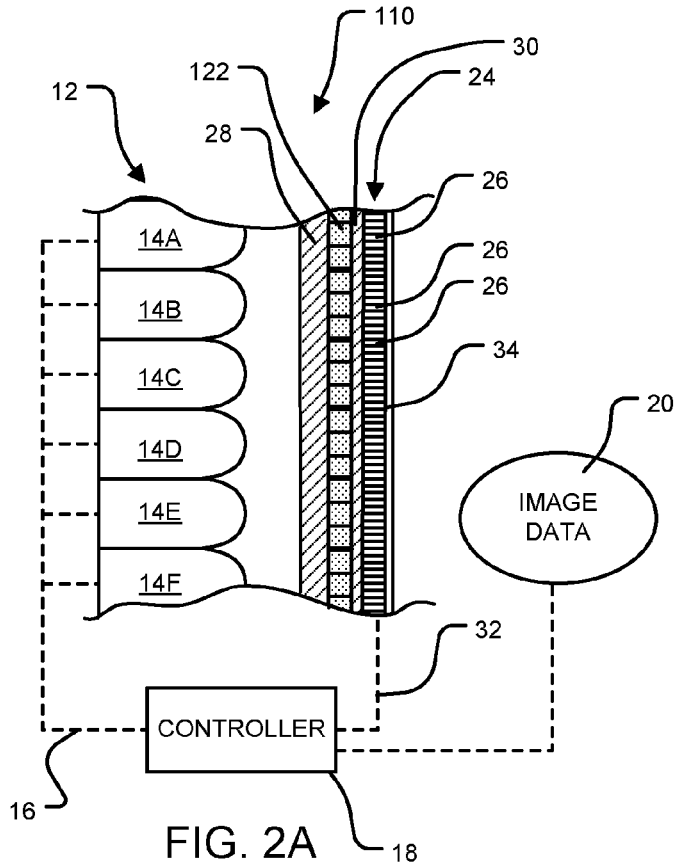
FIG. 2A is a partial cross-section of a dual modulator display according to another particular embodiment of the invention.

FIG. 2A illustrates a dual modulator display 110 according to another embodiment of the invention. In many respects, display 110 is similar to display 10 described above. Display 110 differs from display 10 principally in that phosphorescent plate 122 of display 110 is made up of a patterned plurality of regions 136, wherein each region 136 includes a plurality of sub-regions 134 comprising phosphorescent materials with different emission characteristics.

Figure 2B:
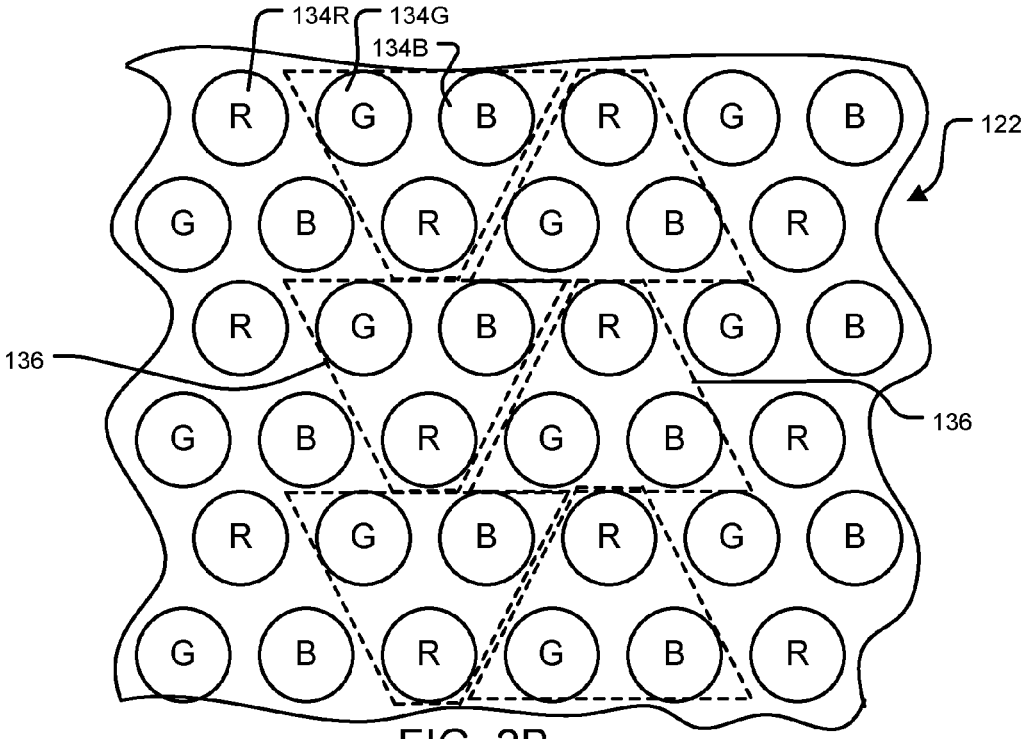
FIG. 2B shows a portion of a phosphorescent plate suitable for use with the FIG. 2A display and a possible arrangement of regions and sub-regions on the phosphorescent plate according to a particular embodiment of the invention.

FIG. 2B shows a portion of a phosphorescent plate 122 according to a particular embodiment suitable for use with display 110 of FIG. 2A. Phosphorescent plate 122 comprises a patterned plurality of regions 136, a number of which are shown by dashed outline in FIG. 2B. Each region 136 comprises a plurality of sub-regions 134. In the illustrated embodiment, each region 136 comprises three sub-regions 134R, 134G, 134B (collectively, sub-regions 134). In other embodiments, regions 136 may comprise different numbers of sub-regions 134. Each sub-region 134 may comprise one or more phosphorescent materials which, when energized by light from light source modulation layer 12, emit light having desired spectral and/or luminosity characteristics.

In the illustrated embodiment, sub-regions 134R emit light having a central wavelength that is generally red, sub-regions 134G emit light having a central wavelength that is generally green and sub-regions 134B emit light having a central wavelength that is generally blue. For example, sub-regions 134R, 134G, 134B may comprise materials which emit light similar to the red, green and blue phosphorescent materials used in current generation CRT displays, such as those of Color Grading Professional Monitors, for example. In other embodiments, where the light emitted by light source modulation layer 12 is blue, sub-region 134B may comprise a transmissive region that passes light from light source modulation layer 12 (i.e. rather than comprising a phosphorescent material with a generally blue spectral emission distribution). In some embodiments, sub-regions 134 may comprise phosphorescent materials that cause them to emit light having other wavelengths. In the illustrated embodiment, sub-regions 134 are schematically depicted as circular, but this is not necessary. Sub-regions 134 may generally be provided with any suitable shapes. In the illustrated embodiment, sub-regions 134 are spaced apart from one another, but this is not necessary and sub-regions 134 may be contiguous with or overlap one another.

Sub-regions 134 may be grouped into regions 136, a number of which are shown in dotted outline in FIG. 2B. In the FIG. 2B embodiment, each region 136 comprises three sub-regions 134 which include one red region 134R, one green region 134G and one blue region 134B and which are arranged in a generally triangular pattern. Accordingly, phosphorescent plate regions 136 of the FIG. 2B embodiment may be referred to as triads 136. In other embodiments, regions 136 may comprise different numbers and/or different orientations of sub-regions 134. Phosphorescent plate 122 and triads 136 may be oriented in a manner similar to that of the shadow mask technique used in CRT displays.

Figure 2C:
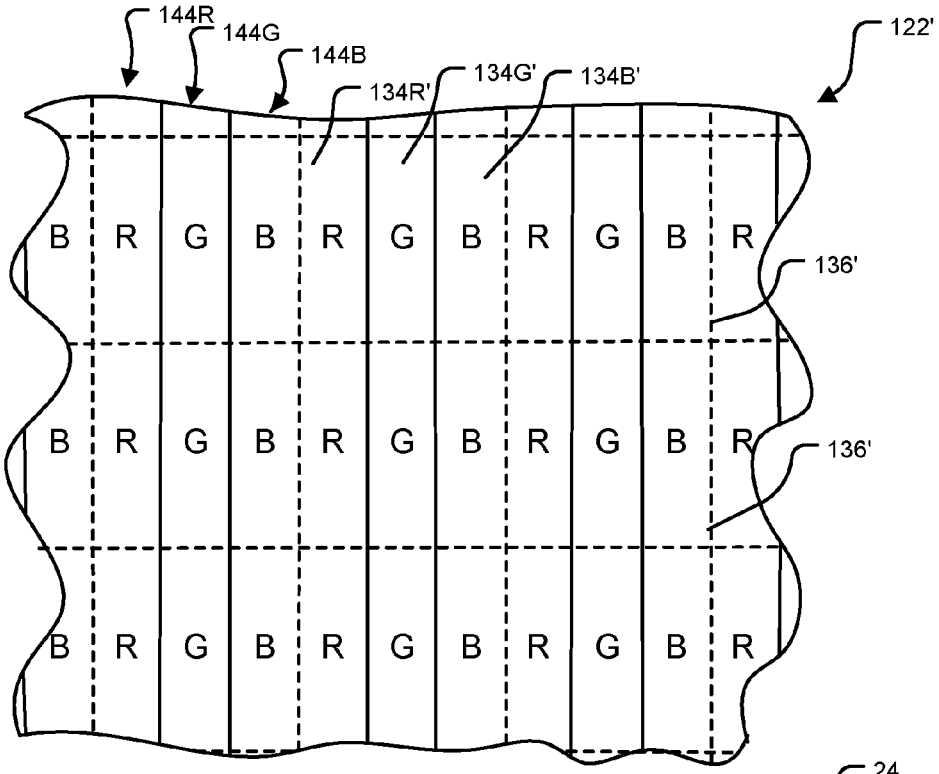
FIG. 2C shows a portion of a phosphorescent plate suitable for use with the FIG. 2A display and a possible arrangement of regions and sub-regions on the phosphorescent plate according to another particular embodiment of the invention.

FIG. 2C shows a portion of a phosphorescent plate 122' according to another particular embodiment suitable for use with display 110 of FIG. 2A. Phosphorescent plate 122' is divided into a repetitive array pattern of three alternating columns 144R, 144G, 144B (collectively columns 144). Columns 144R, 144G, 144B may comprise one or more corresponding phosphorescent materials which, when energized by light from light source modulation layer 12, respectively emit light having central wavelengths that are generally red (column 144R), generally green (column 144G) and generally blue (column 144B). In other embodiments, where the light emitted by light source modulation layer 12 is blue, column 144B may comprise a transmissive column that passes light from light source modulation layer 12 (i.e. rather than comprising a phosphorescent material with a generally blue spectral emission distribution). In some embodiments, columns 144 may comprise phosphorescent materials that cause them to emit light having other wavelengths. In other embodiments, plate 122' may be divided into a repetitive array pattern of a different number of alternating columns 144. In the illustrated embodiment, columns 144 are depicted as being vertically oriented, but this is not necessary. Columns 144 may generally be provided with any suitable orientation.

Like phosphorescent plate 122 of FIG. 2B, phosphorescent plate 122' of FIG. 2C may comprise a plurality of regions 136' shown in dashed outline. Each region 136' may comprise a plurality of sub-regions 134R', 134G', 134B' (collectively sub-regions 134'). In the illustrated embodiment, sub-regions 134R', 134G', 134B' respectively comprise corresponding portions of red, green and blue columns 144R, 144G, 144B. Where columns 144 are generally vertically oriented (as is the case in the illustrated embodiment), regions 136' may be generally rectangularly shaped. In other embodiments, regions 136' may comprise different numbers and/or different orientations of sub-regions 134' and may have different shapes. Phosphorescent plate 122' and regions 136' may be oriented in a manner to that of the aperture grill technique used in CRT displays.

In the discussion that follows, display 110 is described in relation to phosphorescent plate 122, regions 136 and sub-regions 134. It should be understood, however, that phosphorescent plate 122', regions 136' and sub-regions 134' may be used in a manner similar to phosphorescent plate 122, regions 136 and sub-regions 134.

In the illustrated embodiment of FIGS. 2A, 2B and 2C, LEDs 14 (or other modulation elements) of light source modulation layer 12 have the same or approximately similar resolution as regions 136 of phosphorescent plate 122. LEDs 14 of light source modulation layer 12 may be aligned with phosphorescent plate 122 such that light emitted from each LED 14 principally illuminates a corresponding one of phosphorescent plate regions 136. Additionally or alternatively, optional optical system 28 may be constructed such that light emitted from each LED 14 is imaged so as to principally illuminate a corresponding one of phosphorescent plate regions 136. Regions 136 illustrated in FIGS. 2B, 2C are schematic in nature. Light from a particular LED 14 may be permitted spread outside its corresponding phosphorescent plate region 136 in accordance with its point spread function and may overlap light from its neighboring LEDs 14. Such overlapping light may help to provide smoothly spatially varying light at phosphorescent plate 122. The radiation from each LED 14 excites the phosphorescent materials in sub-regions 134 of its corresponding phosphorescent plate region 136 and any phosphorescent plate regions 136 into which it spreads and causes sub-regions 134 of phosphorescent plate 122 to emit light.

The light emitted from a particular phosphorescent plate region 136 comprises a mixture of the light emitted from its corresponding sub-regions 134R, 134G and 134B. The characteristics of the light emitted from a particular phosphorescent plate region 136 and its sub-regions 134 will also depend on the light emitted by its corresponding LED 14—i.e. relatively intense illumination of a particular region 136 of phosphorescent plate 122 will produce correspondingly greater excitation of the materials of its sub-regions 134 such that its sub-regions 134 will emit more light.

The characteristics of the phosphorescent materials used in the sub-regions 134R, 134G, 134B may be selected to provide corresponding light outputs with spectral distributions broad enough to minimize or reduce metameric issues—i.e. to avoid significant intensity changes as a result of metameric shifts amongst human observers (generally found to occur with spectral distributions less than 5 mm). However, the characteristics of the phosphorescent materials used in individual sub-regions 134R, 134G, 134B may be sufficiently narrow to provide high color saturation and a correspondingly wide gamut when filtered through the color filters of display modulation layer 24.

In particular embodiments, sub-regions 134 of phosphorescent plate 22 may be designed to emulate the phosphor emission spectral distributions of CRT displays. For example, in some embodiments: sub-region 134R may comprise material(s) which emit a red mode centered approximately at 575 nm (±5%) and having a full-width half-maximum (FWHM) spread in a range of 110 nm-130 nm; sub-region 134G may comprise material(s) which emit a green mode centered approximately at 540 nm (±5%) and having a FWHM spread in a range of 90 nm-110 nm; and sub-region 134B may comprise material(s) which emit (or may transmit) a blue mode centered approximately at 450 nm (±5%) and having a FWHM spread in a range of 40 nm-60 nm. In other embodiments: sub-region 134R may comprise material(s) which emit a red mode centered approximately at 575 nm (±10%) and having a FWHM spread in a range of 110 nm-130 nm; sub-region 134G may comprise material(s) which emit a green mode centered approximately at 540 nm (±10%) and having a FWHM spread in a range of 90 nm-110 nm; and sub-region 134B may comprise material(s) which emit (or may transmit) a blue mode centered approximately at 450 nm (±10%) and having a FWHM spread in a range of 40 nm-60 nm.

Figure 2D:
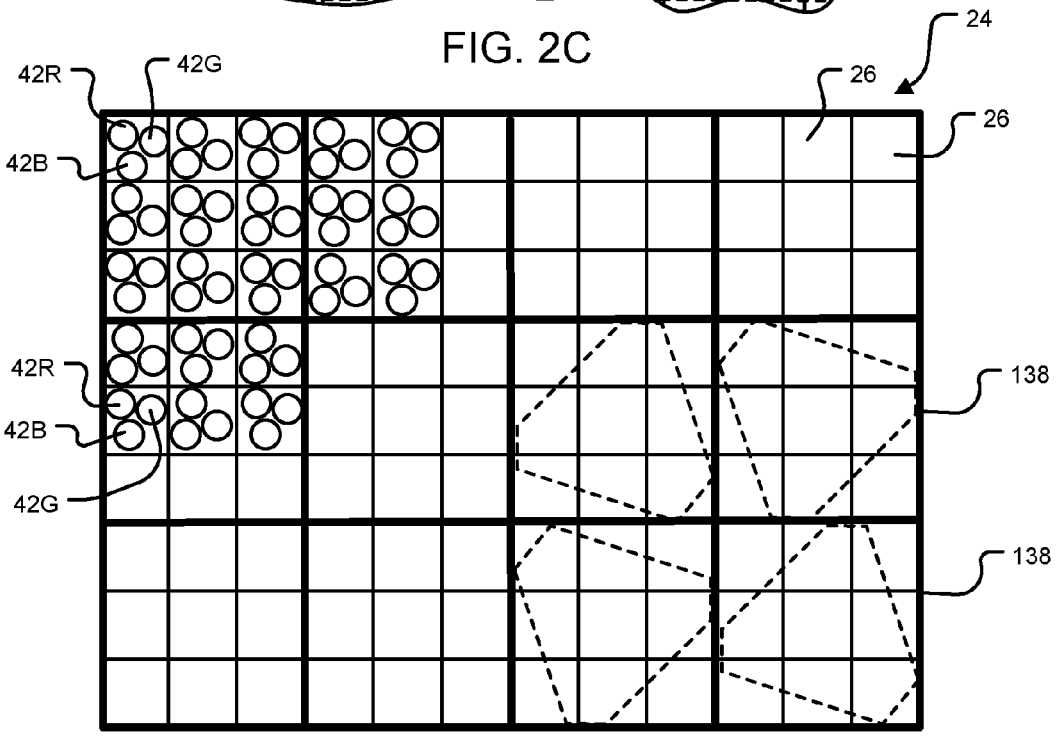
FIG. 2D illustrates a possible relationship between the phosphorescent plate regions of FIG. 2B or FIG. 2C and the pixels in the display modulation layer of the FIG. 2A display.

FIG. 2D illustrates a possible relationship between regions 136 of phosphorescent plate 122 and pixels 26 in display modulation layer 24 of display 110 (FIG. 2A). As discussed above, in the embodiment of display 110, phosphorescent plate regions 136 have the same or similar resolution as LEDs 14 (or other modulators) of light source modulation layer 12. However, the resolution of display modulation layer 24 is greater than that of light source modulation layer 12. In such embodiments, phosphorescent plate 122 may be aligned relative to display modulation layer 24 such that light from the sub-regions 134 of a particular phosphorescent plate region 136 principally illuminates a corresponding region 138 of display modulation layer 24. Additionally or alternatively, optional optical system 30 may be constructed such that light emitted from the sub-regions 134 of a particular phosphorescent plate region 136 is imaged to principally illuminate a corresponding region 138 of display modulation layer 24.

In FIG. 2D, display modulation layer regions 138 which are principally illuminated by a single corresponding phosphorescent plate region 136 are shown in thicker lines. Light from a particular phosphorescent plate region 136 may spread outside its corresponding display modulation layer region 138 and may overlap light from its neighboring phosphorescent plate regions 136. Such overlapping light may help to provide smoothly spatially varying light at display modulation layer 24. In this manner, the interposition of phosphorescent plate 22 between light source modulation layer 12 and display modulation layer 24 influences the point spread function of LEDs 14 (or other modulation components) of light source modulation layer 12. The receipt of light from a particular phosphorescent plate region 136 on a corresponding display modulation layer region 138 is shown schematically in FIG. 2D by dotted outline (representing phosphorescent plate region 136). For clarity, FIG. 2D only shows this dotted outline in some of display modulation layer regions 138. It should be noted that the dotted outline representing phosphorescent plate region 136 in FIG. 2D is schematic and that phosphorescent plate 122 and/or optional optical system 30 may be designed such that light from sub-regions 134 of a particular phosphorescent plate region 136 is spatially mixed and spreads beyond the edges of its corresponding display modulation layer region 138.

Because the resolution of phosphorescent plate regions 136 is the same or similar to the resolution of light source modulation layer 12 and the resolution of display modulation layer 24 is greater than that of light source modulation layer 12, each display modulation layer region 138 comprises a plurality of pixels 26. For example, in the illustrated embodiment, each display modulation layer region 138 comprises nine pixels 26. In other embodiments, each display modulation layer region 138 may comprise a different number of pixels 26. In the illustrated embodiment, each display modulation region 138 is rectangular in shape, but this is not necessary and display modulation regions 138 may generally be provided with other shapes.

As is known in the art of LCD panels, sub-pixels 42 may comprise color filters (e.g. red, green and blue color filters corresponding to sub-pixels 42R, 42G, 42B), which filter the light received thereon. The color filters of sub-pixels 42R, 42G, 42B may be selected to be sufficiently narrow band to pass most or all of the light from a corresponding one of phosphorescent plate sub-regions 134R, 134G, 134B, while attenuating most or all of the light from the other ones of phosphorescent plate sub-regions 134R, 134G, 134B. The color filters of sub-pixels 42R, 42G, 42B may be selected to be sufficiently wide band to pass enough of the spectral distribution generated by their corresponding phosphorescent plate regions 134R, 134G, 134B to minimize or reduce metameric issues associated with overly narrow band colors. In some multi-primary embodiments, it may be desirable to provide a number of color filters that differs from the number of phosphorescent plate sub-regions, in which case, some of the color filters may be configured to pass a fraction of the bandwidth of the light emitted from a phosphorescent plate sub-region. Pixels 26, sub-pixels 42 and other features of display modulation layer 24 of display 110 may otherwise be similar to those described above for display 10.

Operation of display 110 may be substantially similar to operation of display 10 described above, except that because of the patterned array of regions 136 and their respective sub-regions 134, the characteristics and expected response of the regions of phosphorescent plate 122 (e.g. characteristics 59 and the expected response determined in block 57 of method 51) may differ from the characteristics and expected response of phosphorescent plate 22.

Figure 3A:
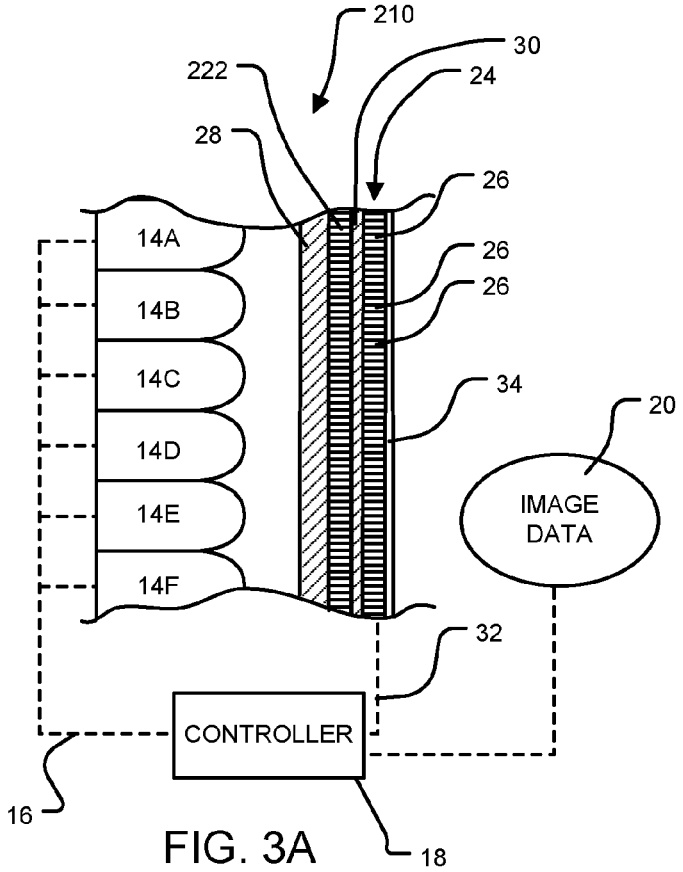
FIG. 3A is a partial cross-section of a dual modulation display according to another particular embodiment of the invention.

FIG. 3A illustrates a dual modulator display 210 according to another embodiment of the invention. In many respects, display 210 is similar to displays 10 and 110 described above. Display 210 differs from display 110 principally in that display 210 comprises a phosphorescent plate 222 having a patterned plurality regions 236 with a resolution greater than that of light source modulation layer 12, whereas display 110 comprises a phosphorescent plate 122 having regions 136 with the same resolution as LEDs 14 of light source modulation layer 12. In the illustrated embodiment, display 210 is actually designed such that phosphorescent plate 222 comprises a patterned plurality of regions 236 having a resolution the same as, or approximately similar to, that of pixels 26 on display modulation layer 24.

Figure 3B:
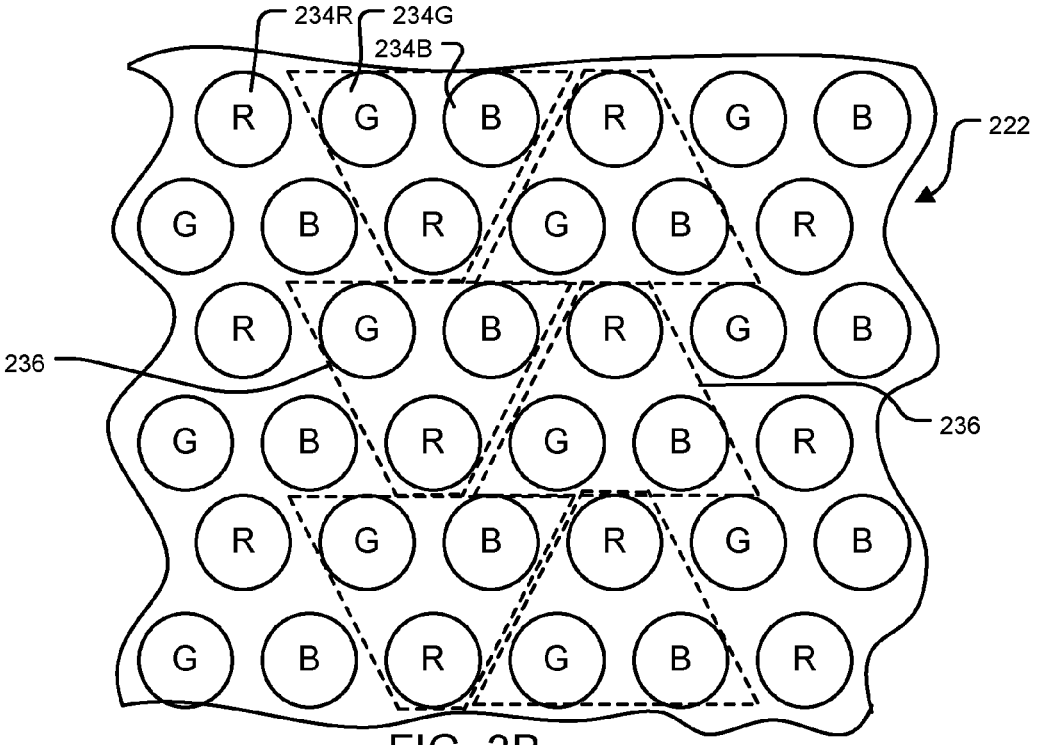
FIG. 3B shows a portion of a phosphorescent plate suitable for use with the FIG. 3A display and a possible arrangement of regions and sub-regions on the phosphorescent plate according to a particular embodiment of the invention.

FIG. 3B illustrates a portion of a phosphorescent plate 222 suitable for use with display 210 of FIG. 3A and a possible arrangement of regions 236 on phosphorescent plate 222 according to a particular embodiment of the invention. Phosphorescent plate 222, regions 236 and sub-regions 234R, 234G, 234B (collectively, sub-regions 234) may be similar to phosphorescent plate 122, regions 136 and sub-regions 134 (FIG. 2B), except that the resolution of the patterned plurality of regions 236 in phosphorescent plate 222 is greater than the resolution of LEDs 14 (or other modulation elements) in light source modulation layer 12.

Figure 3C:
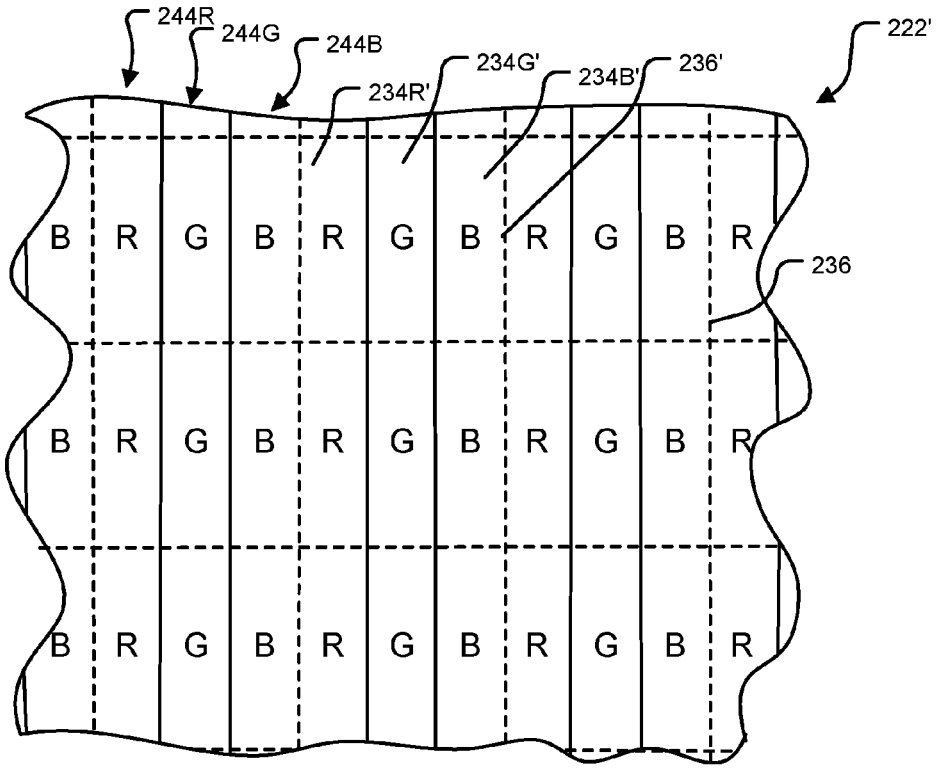
FIG. 3C shows a portion of a phosphorescent plate suitable for use with the FIG. 3A display and a possible arrangement of regions and sub-regions on the phosphorescent plate according to another particular embodiment of the invention.

FIG. 3C illustrates a portion of a phosphorescent plate 222' suitable for use with display 210 of FIG. 3A and a possible arrangement of regions 236' on phosphorescent plate 222' according to a particular embodiment of the invention. Phosphorescent plate 222', regions 236' and sub-regions 234W, 234G', 234B' (collectively, sub-regions 234') may be substantially similar to phosphorescent plate 122', regions 136' and sub-regions 134' (FIG. 2C), except that the resolution of the patterned plurality of regions 236' in phosphorescent plate 222' is greater than the resolution of LEDs 14 (or other modulators) in light source modulation layer 12.

In the discussion that follows, display 210 is described in relation to phosphorescent plate 222, regions 236 and sub-regions 234. It should be understood, however, that phosphorescent plate 222', regions 236' and sub-regions 234' may be used in a manner similar to phosphorescent plate 222, regions 236 and sub-regions 234.

Where the resolution of phosphorescent plate regions 236 is greater than the resolution of LEDs 14 (or other modulation elements) of light source modulation layer 12, LEDs 14 may be aligned with phosphorescent plate 222 such that light emitted from each LED 14 is principally illuminates a corresponding plurality of phosphorescent plate regions 236. Additionally or alternatively, optional optical system 28 may be constructed such that light emitted from each LED 14 is imaged to principally illuminate a corresponding plurality of phosphorescent plate regions 236. Light from particular LEDs 14 is not limited to the plurality of phosphorescent plate regions 236 that it principally illuminates. Light from a particular LED 14 may spread in accordance with its point spread function such that light from adjacent LEDs 14 overlaps at phosphorescent plate 222. Such overlapping light may help to provide smoothly spatially varying light at phosphorescent plate 222. The radiation from LEDs 14 excites the phosphorescent materials in sub-regions 234 of its corresponding plurality of phosphorescent plate regions 236 and any phosphorescent plate regions 236 into which it spreads and causes sub-regions 234 of phosphorescent plate 222 to emit light.

The characteristics of the light emitted from a particular phosphorescent plate region 236 and its sub-regions 234 in response to the light input from light source modulation layer 12 may be similar to those described above for phosphorescent plate regions 136 and sub-regions 134.

Figure 3D:
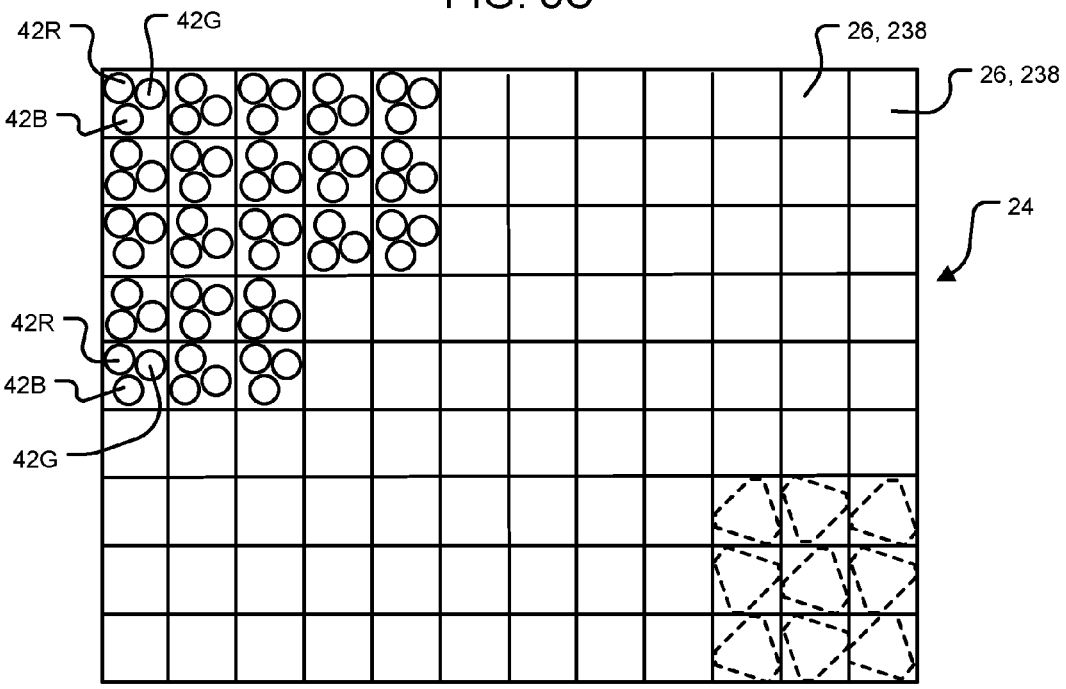
FIG. 3D illustrates a possible relationship between the phosphorescent plate regions of FIG. 3B or FIG. 3C and the pixels in the display modulation layer of the FIG. 3A display.

FIG. 3D illustrates a possible relationship between regions 236 of phosphorescent plate 222 and pixels 26 in display modulation layer 24 of display 210 (FIG. 3A). In the embodiment of display 210, phosphorescent plate regions 236 have a resolution greater than that of light source modulation layer 12. In the particular example embodiment illustrated in FIG. 3D, phosphorescent plate regions 236 have a resolution that is the same or similar to the resolution of pixels 26 in display modulation layer 24. In such embodiments, phosphorescent plate 222 may be designed or aligned relative to display modulation layer 24 such that light from the sub-regions 234 of a particular phosphorescent plate region 236 principally illuminates a corresponding pixel 26/region 238 of display modulation layer 24. Additionally or alternatively, optional optical system 30 may be constructed such that light emitted from the sub-regions 234 of a particular phosphorescent plate region 236 is imaged to principally illuminate a corresponding pixel 26/region 238 of display modulation layer 24. Light from a particular phosphorescent plate region 236 may spread outside its corresponding display illumination layer pixel 26/region 238 and may overlap one or more neighboring pixels 26/regions 138. Such overlapping light may help to provide smoothly spatially varying light at display modulation layer 24. In this manner, the interposition of phosphorescent plate 22 between light source modulation layer 12 and display modulation layer 24 influences the point spread function of LEDs 14 (or other modulation components) of light source modulation layer 12.

In FIG. 3D, the receipt of light from a particular phosphorescent plate region 236 on a corresponding pixel 26 of display modulation layer 24 is shown schematically by dotted outline. For clarity, FIG. 3D only shows this dotted outline in some of pixels 26. It should be noted that the dotted outline representing phosphorescent plate region 236 in FIG. 3D is schematic and that phosphorescent plate 222 and/or optional optical system 30 may be designed such that light from sub-regions 234 of a particular phosphorescent plate region 236 is mixed and spreads beyond the edges of its corresponding pixel 26/region 238.

Pixels 26, sub-pixels 42 and other features of display modulation layer 24 of display 210 may be similar to those described above for display 110.

In operation, controller 18 controls the output of individual modulation elements (e.g. LEDs 14) of light source modulation layer 12 using drive signals 16 as described above. Light from each of LEDs 14 excites a corresponding plurality of phosphorescent plate regions 236 in phosphorescent plate 222. Controller 20 also determines drive values for each sub-pixel 42 of each pixel 26 of display modulation layer 24 and outputs these drive values as drive signals 32. Drive signals 32 may be determined based at least in part on one or more of: image data 20; driving signals 16; the expected light output for LEDs 14 of light source modulation layer 12; and the corresponding expected light output of phosphorescent plate regions 236 and their corresponding sub-regions 234. As discussed above, method 51 of FIG. 1D represents one particular technique for determining drive signals 32.

In some embodiments of display 210, where the resolution of the patterned plurality of phosphorescent plate regions 236 on phosphorescent plate 222 is the same or similar to that of pixels 26, the sub-regions 234 of phosphorescent plate regions 236 may perform the function of color filters which would otherwise be part of display modulation layer 24. In such embodiments, each sub-pixel 42 of display modulation layer 24 may be implemented with a controllable liquid crystal element but without the need for a color filter.

In such embodiments, there may be a correspondence or registration (e.g. a one-to-one relationship) between sub-regions 234 of a particular region 236 on phosphorescent plate 222 and sub-pixels 42 of a particular pixel 26/region 238 on display modulation layer 24. Light emitted from sub-regions 234 of a particular region 236 on phosphorescent plate 222 may remain substantially unmixed prior to illuminating corresponding sub-pixels 42 of display modulation layer 24. By way of non-limiting example, light from individual sub-regions 234 of a particular region 236 on phosphorescent plate 22 may be channelled by reflective walled channels (which may be part of optional optical system 30) to corresponding sub-pixels 42 of display modulation layer 24. While light may still extend outside sub-pixels 42 in such embodiments, the extension of light outside sub-pixels 42 may be relatively minimal and there may be relatively rapid changes in illumination at the boundaries between sub-pixels 42.

Figure 3E:
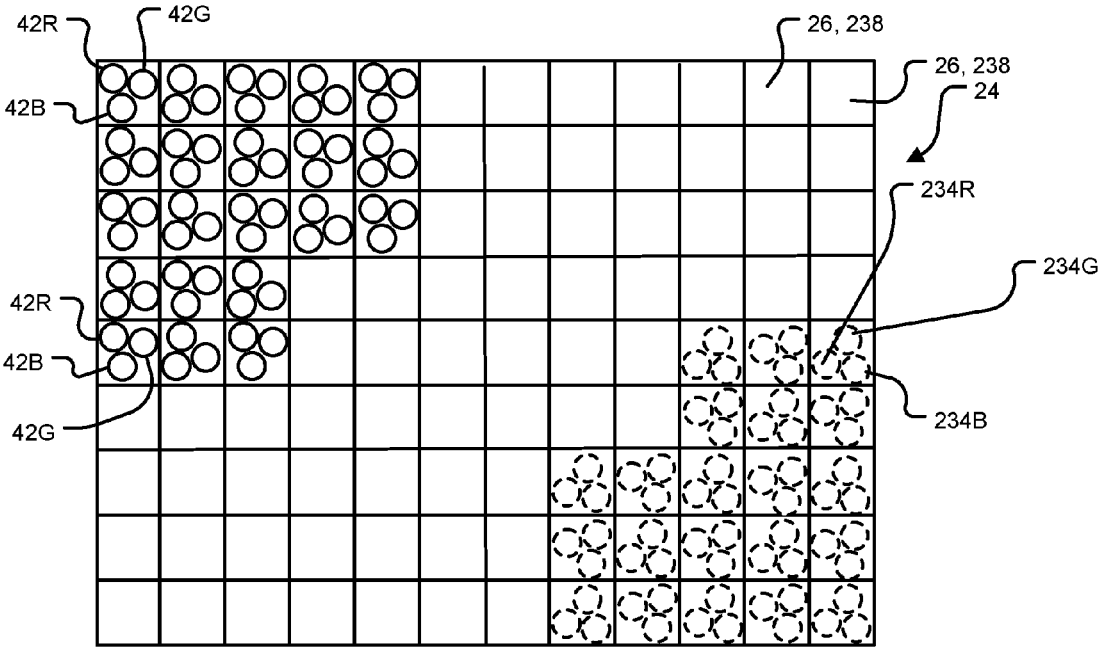
FIG. 3E illustrates a different possible relationship between the phosphorescent plate regions of FIG. 3B or FIG. 3C and the pixels in the display modulation layer of the FIG. 3A display wherein there is a registration between the sub-regions of the phosphorescent plate and the sub-pixels of the display modulation layer.

This registration between sub-regions 234 of phosphorescent plate 222 and sub-pixels 42 of display modulation layer is shown in FIG. 3E, www which shows individual phosphorescent plate sub-regions 234 in dotted outline in some of pixels 26 and sub-pixels 42 in some of pixels 26. Phosphorescent plate 222 may be designed or aligned relative to display modulation layer 24 such that light from each sub-region 234 of a particular phosphorescent plate region 236 principally illuminates a liquid crystal element of a corresponding sub-pixel 42 of a display modulation layer pixel 26/region 238. Additionally or alternatively, optional optical system 30 may be constructed such that light emitted from each sub-region 234 of a particular phosphorescent plate region 236 is imaged to principally illuminate a liquid crystal element of a corresponding sub-pixel 42 of a display modulation layer pixel 26/region 238.

Display 110 described above comprises a phosphorescent plate 122 having a patterned plurality of regions 136 with a resolution that is the same or similar to that of light source modulation layer 12. Display 210 comprises a phosphorescent plate 222 having a patterned plurality of regions 236 with a resolution that is the same or similar to that of display modulation layer 24. These are merely representative examples of the resolutions of patterned phosphorescent plates which may be used in accordance with various embodiments of the invention. In other embodiments, the resolution of the patterned regions on phosphorescent plates may be any suitable resolution. In particular embodiments, the resolution of the patterned regions on phosphorescent plates may be greater than or equal to that of the lesser one of light source modulation layer 12 and display modulation layer 24. For example, the resolution of patterned phosphorescent plates in some embodiments may be somewhere between the resolutions of light source modulation layer 12 and display modulation layer 24 or greater than the resolution of display modulation layer 24. It should be noted that it is not necessary for phosphorescent plates to comprise a plurality of regions. In embodiments, such as display 10 described above, the phosphorescent materials in plate 22 may be mixed so as to emit light having desirable spectral characteristics from whatever portion of plate 22 is illuminated by light from light source modulation layer 12. In some embodiments, the mixture of phosphorescent materials on a phosphorescent plate is homogeneous, though this is not necessary.

Figure 4:
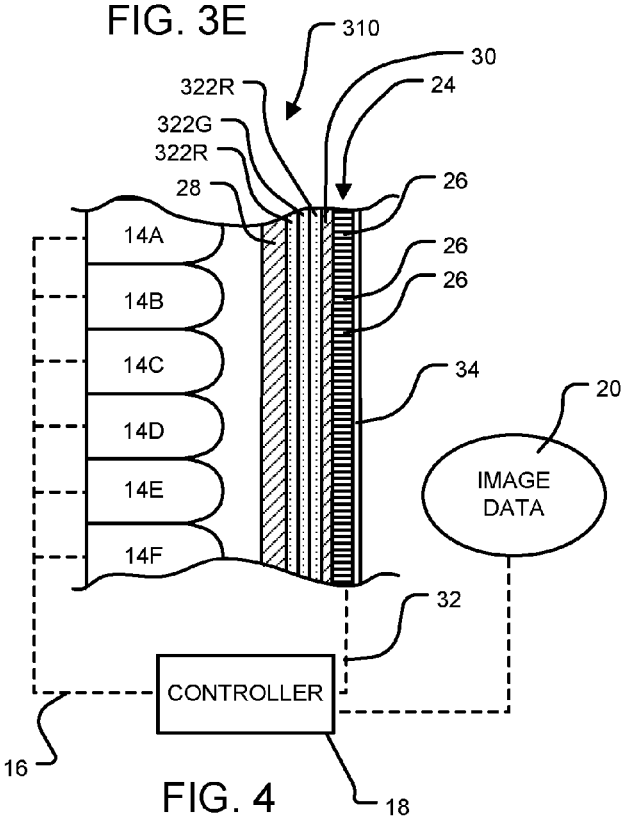
FIG. 4 is a partial cross-section of a dual modulation display according to another particular embodiment of the invention.

Displays 110, 210 described above comprise phosphorescent plates 122, 222 having patterned pluralities of regions 136, 236, wherein each region 136, 236 comprises a plurality of sub-regions 134, 234 having different spectral emission characteristics. FIG. 4 depicts a partial cross-section of a display 310 according to another embodiment of the invention comprising a plurality of phosphorescent plates 322R, 322G, 322B (collectively, phosphorescent plates 322) interposed in the optical path between light source modulation layer 12 and display modulation layer 24. Each phosphorescent plate 322 may comprise a different spectral emission characteristic. By way of non-limiting example, phosphorescent plate 322R may emit light with generally red wavelengths, phosphorescent plate 322G may emit light with generally green wavelengths and phosphorescent plate 322B may emit light with generally blue wavelengths. In embodiments, where light source modulation layer 12 emits blue light, the blue phosphorescent plate 322B may be at least partially transparent or may not be present at all. Phosphorescent plates 322R, 322G, 322B may have spectral emission characteristics similar to those of phosphorescent plate sub-regions 134R, 134G, 134B described above. Phosphorescent plates emitting other central wavelengths and having other spectral profiles may also be used. Phosphorescent plates 322 may be contiguous with one another or spaced apart from one another. Display 310 may additionally or alternatively comprise several phosphor layers within the same plate, wherein each phosphor layer comprises a different spectral emission characteristic. In some embodiments, any two or more of phosphorescent plates 322 may comprise layers within a single monolithic phosphorescent plate.

The light received at pixels 26 of display modulation layer 24 in display 310 and other similar embodiments may be similar to that received in displays 110, 210 described above in that the phosphorescent materials used in the various plates 322 may be selected to provide corresponding light outputs with spectral distributions broad enough to minimize or reduce metameric issues and sufficiently narrow to provide high color saturation and a correspondingly wide gamut when filtered through the color filters of display modulation layer 24.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

Thus, embodiments of the present invention may relate to one or more of the enumerated example embodiments below, each of which are examples, and, as with any other related discussion provided above, should not be construed as limiting any claim or claims provided yet further below as they stand now or as later amended, replaced, or added. Likewise, these examples should not be considered as limiting with respect to any claim or claims of any related patents and/or patent applications (including any foreign or international counterpart applications and/or patents, divisionals, continuations, re-issues, etc.).

EXAMPLES

Enumerated Example Embodiment (EEE) 1

A display comprising:

a light source modulation layer comprising a first array of modulation elements having a first resolution;

a display modulation layer comprising a second array of modulation elements having a second resolution;

a controller configured to receive image data and to determine first drive signals for the modulation elements of the light source modulation layer based at least in part on the image data, the light source modulation layer emitting a first spatially varying light pattern in response to the first drive signals;

a phosphorescent plate interposed in an optical path between the light source modulation layer and the display modulation layer to receive the first spatially varying light pattern, the phosphorescent plate comprising one or more materials which emit a second spatially varying light pattern in response to receiving the first spatially varying light pattern, the second spatially varying light pattern having a spectral distribution different from that of the first spatially varying light pattern;

wherein the controller is configured to determine second drive signals for the modulation elements of the display modulation layer based at least in part on the image data and expected characteristics of the second spatially varying light pattern when received at the display modulation layer.

EEE2

A display according to EEE1 wherein the phosphorescent plate is contiguous with the display modulation layer.

EEE3

A display according to EEE1 wherein the phosphorescent plate is spaced apart from the display modulation layer by a distance less than or equal to five times a dimension of the modulation elements of the display modulation layer.

EEE4

A display according to any of EEE1 to 3 wherein the phosphorescent plate comprises a patterned plurality of regions, each region comprising a plurality of sub-regions and each sub-region comprising one or more materials which cause the sub-region to emit light having a unique spectral distribution relative to the other sub-regions within the same region in response to receiving light from the first spatially varying light pattern.

EEE5

A display according to EEE4 wherein the plurality of sub-regions within each region comprise a red sub-region which emits light having a generally red central wavelength, a green sub-region which emits light having a generally green central wavelength and a blue sub-region which emits light having a generally blue central wavelength.

EEE6

A display according to EEE4 wherein the plurality of sub-regions within each region comprise a red sub-region which emits light having a central wavelength of about 575 nm (±5%) and having a full-width half-maximum (FWHM) spread in a range of 110 nm-130 nm, a green sub-region which emits light having a central wavelength of 540 nm (±5%) and having a FWHM spread in a range of 90 nm-110 nm and a blue sub-region which emits light having a central wavelength of about 450 nm (±5%) and having a FWHM spread in a range of 40 nm-60 nm.

EEE7

A display according to EEE4 wherein the plurality of sub-regions within each region comprise a red sub-region which emits light having a central wavelength of about 575 nm (±10%) and having a full-width half-maximum (FWHM) spread in a range of 110 nm-130 nm, a green sub-region which emits light having a central wavelength of 540 nm (±10%) and having a FWHM spread in a range of 90 nm-110 nm and a blue sub-region which emits light having a central wavelength of about 450 nm (±10%) and having a FWHM spread in a range of 40 nm-60 nm.

EEE8

A display according to any one of EEE4 to 7 wherein the light emitted from the plurality of sub-regions within each region is mixed when received at the display modulation layer to form a contribution to the second spatially varying light pattern received at the display modulation layer.

EEE9

A display according to any one of EEE4 to 8 wherein a resolution of the patterned plurality of regions is greater than or equal to the first resolution.

EEE10

A display according to any one of EEE4 to 8 wherein a resolution of the patterned plurality of regions is greater than or equal to the first resolution and less than or equal to the second resolution.

EEE11

A display according to any one of EEE4 to 8 wherein a resolution of the patterned plurality of regions is greater than the first resolution and the same as or substantially similar to the second resolution.

EEE12

A display according to any one of EEE4 to 8 wherein a resolution of the patterned plurality of regions is greater than or equal to the first resolution and the second resolution.

EEE13

A display according to any one of EEE1 to 12 wherein the controller is configured to determine a first estimate of the first spatially varying light pattern received at the phosphorescent plate based at least in part on the first drive signals.

EEE14

A display according to EEE13 wherein the controller is configured to determine the first estimate based at least in part on light output characteristics of the modulation elements of the first array.

EEE15

A display according to EEE14 wherein the modulation elements of the first array comprise LEDs and the light output characteristics of the modulation elements of the first array comprise point spread functions of the LEDs.

EEE16

A display according to any one of EEE13 to 15 wherein the controller is configured to determine a second estimate of the expected characteristics of the second spatially varying light pattern received at the display modulation layer based at least in part on the first estimate.

EEE17

A display according to EEE16 wherein the controller is configured to determine the second estimate based at least in part on light output characteristics of the phosphorescent plate.

EEE18

A display according to EEE17 wherein the light output characteristics of the phosphorescent plate comprise a transfer function which relates light received on the phosphorescent plate to light output by the phosphorescent plate.

EEE19

A display according to any one of claims 1 to 12 wherein the modulation elements of the first array comprise LEDs and wherein the controller is configured to determine an estimate of the expected characteristics of the second spatially varying light pattern received at the display modulation layer based at least in part on the first drive signals and modified point spread functions of the LEDs, the modified point spread functions incorporating a transfer function of the phosphorescent plate which relates light received on the phosphorescent plate to light output by the phosphorescent plate.

EEE20

A display comprising:

a backlight which is controllable to emit a first spatially varying light pattern;

a phosphorescent plate located to be illuminated by the first spatially varying light pattern and comprising one or more materials which emit a second spatially varying light pattern in response to receiving the first spatially varying light pattern, the second spatially varying light pattern having a spectral distribution different from that of the first spatially varying light pattern; and a display modulation layer located to receive the second spatially varying light pattern, the display modulation layer controllable to spatially modulate the second spatially varying light pattern and to thereby provide a third spatially varying light pattern, the third spatially varying light pattern having a spatial variation different from that of the second spatially varying light pattern.

EEE21

A method for displaying an image on a dual modulator display comprising a light source modulation layer incorporating a first array of modulation elements and a display modulation layer incorporating a second array of modulation elements, the method comprising:

receiving image data;

determining first drive signals for the modulation elements of the light source modulation layer based at least in part on the image data, the first drive signals, when applied to the modulation elements of the light source modulation layer, causing the light source modulation layer to emit a first spatially varying light pattern;

providing a phosphorescent plate interposed in an optical path between the light source modulation layer and the display modulation layer to receive the first spatially varying light pattern, the phosphorescent plate comprising one or more materials which emit a second spatially varying light pattern in response to receiving the first spatially varying light pattern, the second spatially varying light pattern having a spectral distribution different from that of the first spatially varying light pattern;

determining second drive signals for the modulation elements of the display modulation layer based at least in part on the image data and expected characteristics of the second spatially varying light pattern when received at the display modulation layer; and displaying the image by applying the first drive signals to the light source modulation layer and the second drive signals to the display modulation layer.

EEE22

A method according to EEE21 wherein providing the phosphorescent plate interposed in the optical path between the light source modulation layer and the display modulation layer comprises locating the phosphorescent plate contiguous with the display modulation layer.

EEE23

A method according to EEE21 wherein providing the phosphorescent plate interposed in the optical path between the light source modulation layer and the display modulation layer comprises locating the phosphorescent plate at a location spaced apart from the display modulation layer by a distance less than or equal to five times a dimension of the modulation elements of the display modulation layer.

EEE24

A method according to any EEE21 to 23 wherein the phosphorescent plate comprises a patterned plurality of regions, each region comprising a plurality of sub-regions and each sub-region comprising one or more materials which cause the sub-region to emit light having a unique spectral distribution relative to the other sub-regions within the same region in response to receiving light from the first spatially varying light pattern.

EEE25

A method according to EEE24 wherein the plurality of sub-regions within each region comprise a red sub-region which emits light having a generally red central wavelength, a green sub-region which emits light having a generally green central wavelength and a blue sub-region which emits light having a generally blue central wavelength.

EEE26

A method according to EEE24 wherein the plurality of sub-regions within each region comprise a red sub-region which emits light having a central wavelength of about 575 nm (±5%) and having a full-width half-maximum (FWHM) spread in a range of 110 nm-130 nm, a green sub-region which emits light having a central wavelength of 540 nm (±5%) and having a FWHM spread in a range of 90 nm-110 nm and a blue sub-region which emits light having a central wavelength of about 450 nm (±5%) and having a FWHM spread in a range of 40 nm-60 nm.

EEE27

A method according to EEE24 wherein the plurality of sub-regions within each region comprise a red sub-region which emits light having a central wavelength of about 575 nm (±10%) and having a full-width half-maximum (FWHM) spread in a range of 110 nm-130 nm, a green sub-region which emits light having a central wavelength of 540 nm (±10%) and having a FWHM spread in a range of 90 nm-110 nm and a blue sub-region which emits light having a central wavelength of about 450 nm (±10%) and having a FWHM spread in a range of 40 nm-60 nm.

EEE28

A method according to any one of EEE24 to 27 wherein the light emitted from the plurality of sub-regions within each region is mixed when received at the display modulation layer to form a contribution to the second spatially varying light pattern received at the display modulation layer.

EEE29

A method according to any one of EEE24 to 28 wherein the first array of the modulation elements of the light source modulation layer comprises a first resolution and a resolution of the patterned plurality of regions is greater than or equal to the first resolution.

EEE30

A method according to any one of EEE24 to 28 wherein the first array of the modulation elements of the light source modulation layer has a first resolution, the second array of modulation elements of the display modulation layer has a second resolution and a resolution of the patterned plurality of regions is greater than or equal to the first resolution and less than or equal to the second resolution.

EEE31

A method according to any one of EEE24 to 28 wherein the first array of the modulation elements of the light source modulation layer has a first resolution, the second array of modulation elements of the display modulation layer has a second resolution and a resolution of the patterned plurality of regions is greater than the first resolution and the same as or substantially similar to the second resolution.

EEE32

A method according to any one of EEE24 to 28 wherein the first array of the modulation elements of the light source modulation layer has a first resolution, the second array of modulation elements of the display modulation layer has a second resolution and a resolution of the patterned plurality of regions is greater than or equal to the first resolution and the second resolution.

EEE33

A method according to any one of EEE21 to 32 comprising determining a first estimate of the first spatially varying light pattern received at the phosphorescent plate based at least in part on the first drive signals.

EEE34

A method according to EEE33 comprising determining the first estimate based at least in part on light output characteristics of the modulation elements of the first array.

EEE35

A method according to EEE34 wherein the modulation elements of the first array comprise LEDs and the light output characteristics of the modulation elements of the first array comprise point spread functions of the LEDs.

EEE36

A method according to any one of EEE33 to 35 comprising determining a second estimate of the expected characteristics of the second spatially varying light pattern received at the display modulation layer based at least in part on the first estimate.

EEE37

A method according to EEE36 wherein comprising determining the second estimate based at least in part on light output characteristics of the phosphorescent plate.

EEE38

A method according to EEE37 wherein the light output characteristics of the phosphorescent plate comprise a transfer function which relates light received on the phosphorescent plate to light output by the phosphorescent plate.

EEE39

A method according to any one of claims 21 to 32 wherein the modulation elements of the first array comprise LEDs and wherein the method comprises determining an estimate of the expected characteristics of the second spatially varying light pattern received at the display modulation layer based at least in part on the first drive signals and modified point spread functions of the LEDs, the modified point spread functions incorporating a transfer function of the phosphorescent plate which relates light received on the phosphorescent plate to light output by the phosphorescent plate.

EEE40

A method for displaying an image on a dual modulator display comprising a light source modulation layer and a display modulation layer, the method comprising:

controlling the light source modulation layer to emit a first spatially varying light pattern;

providing a phosphorescent plate located to be illuminated by the first spatially varying light pattern and comprising one or more materials which emit a second spatially varying light pattern in response to receiving the first spatially varying light pattern, the second spatially varying light pattern having a spectral distribution different from that of the first spatially varying light pattern and the second spatially varying light pattern received at the display modulation layer; and controlling the display modulation layer to spatially modulate the second spatially varying light pattern and to thereby provide a third spatially varying light pattern, the third spatially varying light pattern having a spatial variation different from that of the second spatially varying light pattern.

EEE41

A display comprising any feature, combination of features or sub-combination of features described or reasonably inferred from the description provided herewith.

EEE42

A method for displaying images comprising any feature, combination of features or sub-combination of features described or reasonably inferred from the description provided herewith.

As will be apparent to those skilled in the art in the light of the foregoing disclosure, many alterations and modifications are possible in the practice of this invention without departing from the spirit or scope thereof. For example:

In the embodiments described above, phosphorescent plates are interposed in the optical path between modulation layers of dual modulator displays. In some embodiments, phosphorescent plates may be interposed between the modulation layers of multi-modulator displays having three or more modulation layers.

The embodiments described herein are backlit dual modulator displays. The invention has application, however, to projection type displays and displays incorporating reflective (rather than transmissive) display modulation layers, similar to those described in the Dual Modulation Display Applications.

In some embodiments, the phosphorescent materials used in the phosphorescent plates (e.g. phosphorescent plates 22, 122, 222, 322) may be distributed with a desired profile (e.g. a profile of density or thickness or the like) which may impact the point spread function of the light emitted therefrom. For example, if a point spread function of a particular modulation element (e.g. LED 14) of the light source modulation layer has a point spread function that is undesirably high in the center and undesirably low in the tail, then the phosphorescent material corresponding to that modulation element could have a relatively high density at the outside and a low density at the center, so as to influence the point spread function of the light received at the display modulation layer (e.g. to provide a relative increase of the point spread function at the tail relative to the center). Such an effect could also be provided with phosphorescent materials of different efficiency. Generally speaking, the interposition of phosphorescent plates (e.g. phosphorescent plates 22, 122, 222, 322) between light source modulation layer 12 and display modulation layer 24 provides display design engineers with an extra "transfer function" that may be tailored using characteristics (e.g. density and emission efficiency) of phosphorescent materials to provide desirable illumination profile at display modulation layer 24. This extra transfer function is represented in method 51 (FIG. 1D) as phosphorescent plate characteristics 59. It will be appreciated that selection of appropriate phosphorescent plate characteristics 59 will influence the characteristics of the illumination received at display modulation layer 24.

Phosphors are not the only materials capable of performing photon-to-photon conversion of the type described above—i.e. receiving first photons having a first set of spectral properties and outputting second photons having a second set of spectral properties. The invention should be understood to include any other suitable materials capable of such photon-to-photon conversion (such as, by way of non-limiting example, photoluminescent quantum dots) and references to phosphors used herein should be understood to include any such materials.

In the description provided herein, phosphorescent materials are described as being provided in plates. This is not necessary. In other embodiments, phosphorescent materials having similar functional attributes may be provided in form factors other than plates.

In the embodiments described above, light source modulation layer 12 is described as emitting light having one spectral characteristic. This is not necessary. In some embodiments, light source modulation layer 12 may emit light having multimodal spectral characteristics. For example, diodes 14 of light source modulation layer 12 may comprise groups of diodes having different spectral distributions (e.g. red, green and blue diodes). Light source modulation layer 12 may comprise other components for generating multimodal spectral distributions. In some embodiments, phosphorescent plates may comprise phosphorescent materials which are selectively responsive to different modes of the multimodal spectral distribution from light source modulation layer 12. Such plates may comprise mixtures of phosphorescent materials or patterned regions of phosphorescent materials.

Phosphorescent material may be coated on phosphorescent plates or may be incorporated into phosphorescent plates.

In some embodiments, it may be desirable for phosphor plates to absorb, reflect or otherwise not pass some of the light emitted from light source modulation layer.

What is claimed:

1. A nano-crystal display comprising:

a crystal conversion layer disposed in an optical path between a modulated light source and a display modulator, the crystal conversion layer configured to receive a first spatially varying light pattern from the modulated light source, crystals in the conversion layer comprising a material configured to cause a conversion comprising a change in properties of the first spatially varying light pattern to produce a second spatially varying light pattern, the second spatially varying light pattern having a spectral distribution different from that of the first spatially varying light pattern;

wherein the crystal conversion layer comprises a patterned plurality of regions, each region comprising a plurality of sub-regions each configured to emit light having a unique spectral distribution relative to the other sub-regions within the same region in response to receiving light from the modulated light source;

wherein the plurality of sub-regions within each region comprise a first sub-region which emits light having a first central wavelength, a second sub-region which emits light having a second central wavelength and a third sub-region which emits light having a third central wavelength;

further wherein the sub-regions are configured to illuminate an area of the display modulator and further wherein the display modulator comprises a set of color filtered subpixels to provide a wide color gamut;

wherein a controller is configured to energize the modulated light source to produce the first spatially varying light pattern based on image data, and determine second drive signals for the modulation elements of the display modulation layer based on the image data and expected characteristics of the second spatially varying light pattern when received at the display modulation layer.

2. The nano-crystal display according to claim 1, wherein the crystal conversion layer comprises nanoscale semiconductor devices that tightly confine electrons or electron holes.

3. The nano-crystal display according to claim 1, wherein the crystal conversion layer comprises quantum dots.

4. The nano-crystal display according to claim 1, wherein the crystal conversion layer comprises crystals synthesized from precursor compounds dissolved in solutions.

5. The nano-crystal display according to claim 1, wherein the crystal conversion layer is spaced apart from the display modulation layer by a distance less than or equal to five times a dimension of the modulation elements of the display modulation layer.

6. The nano-crystal display according to claim 1, wherein the crystal conversion layer comprises a patterned plurality of regions, each region comprising a plurality of sub-regions each configured to emit light having a unique spectral distribution relative to the other sub-regions within the same region in response to receiving light from the modulated light source.

7. The nano-crystal display according to claim 6, wherein the plurality of sub-regions within each region comprise a red sub-region which emits light having a red central wavelength, a green sub-region which emits light having a green central wavelength and a blue sub-region which emits light having a blue central wavelength.

8. The nano-crystal display according to claim 6, wherein the plurality of sub-regions exhibit light spread function having a full-width at half max in a range from 40 nm to 130 nm.

9. The nano-crystal display according to claim 6, wherein the plurality of sub-regions within each region comprise a red sub-region which emits light having a central wavelength of about 575 nm (±10%) and having a full-width half-maximum (FWHM) spread in a range of 110 nm-130 nm, a green sub-region which emits light having a central wavelength of 540 nm (±10%) and having a FWHM spread in a range of 90 nm-110 nm and a blue sub-region which emits light having a central wavelength of about 450 nm (±10%) and having a FWHM spread in a range of 40 nm-60 nm.

10. The nano-crystal display according to claim 6, wherein the light emitted from the plurality of sub-regions within each region is mixed when received at the display modulation layer to form a contribution to the second spatially varying light pattern received at the display modulation layer.

11. The nano-crystal display according to claim 10, wherein a resolution of the patterned plurality of regions is greater than or equal to a resolution of the first spatially varying light pattern and less than or equal to a resolution of the display modulation layer.

12. The nano-crystal display according to claim 1, wherein the controller is configured to determine a first estimate of the first spatially varying light pattern received at the conversion layer based at least in part on the first drive signals.

13. The nano-crystal display according to claim 1, wherein the modulated light source comprises LEDs and wherein the controller is configured to determine an estimate of the expected characteristics of the second spatially varying light pattern received at the display modulation layer based at least in part on the first drive signals and modified point spread functions of the LEDs, the modified point spread functions incorporating a transfer function of the crystal conversion layer which relates light received on the crystal conversion layer to the second spatially varying light pattern.

14. A nano-scale display comprising:

a backlight which is controllable to emit a first spatially varying light pattern;

a nano particle conversion plate located to be illuminated by the first spatially varying light pattern and comprising one or more materials which emit a second spatially varying light pattern in response to receiving the first spatially varying light pattern, the second spatially varying light pattern having a spectral distribution different from that of the first spatially varying light pattern;

wherein the nano particle conversion plate comprises a patterned plurality of regions, each region comprising a plurality of sub-regions each configured to emit light having a unique spectral distribution relative to the other sub-regions within the same region in response to receiving light from the modulated light source;

wherein the plurality of sub-regions within each region comprise a first sub-region which emits light having a first central wavelength, a second sub-region which emits light having a second central wavelength and a third sub-region which emits light having a third central wavelength;

further wherein the sub-regions are configured to illuminate an area of the display modulator and further wherein the display modulator comprises a set of color filtered subpixels to provide a wide color gamut; and a display modulation layer located to receive the second spatially varying light pattern, the display modulation layer controllable to spatially modulate the second spatially varying light pattern and to thereby provide a third spatially varying light pattern, the third spatially varying light pattern having a spatial variation different from that of the second spatially varying light pattern.

15. A method for displaying an image on a display comprising a light source layer, nano-scale particles, and a display modulation layer incorporating an array of modulation elements, the method comprising:

receiving image data;

determining first drive signals for the light source layer based at least in part on the image data, the first drive signals, when applied to the modulation elements of the light source modulation layer, causing the light source layer to emit a first spatially varying light pattern;

converting light via nano-scale particles in an optical path between the light source layer and the display modulation layer, the light conversion being performed via materials which emit a second spatially varying light pattern in response to receiving the first spatially varying light pattern, the second spatially varying light pattern having a spectral distribution different from that of the first spatially varying light pattern;

determining second drive signals for the modulation elements of the display modulation layer based at least in part on the image data and expected characteristics of the second spatially varying light pattern when received at the display modulation layer; and displaying the image by applying the first drive signals to the light source layer and the second drive signals to the display modulation layer;

wherein the nano-scale particles are arranged in a patterned plurality of regions, each region comprising a plurality of sub-regions each configured to emit light having a unique spectral distribution relative to the other sub-regions within the same region in response to receiving light from the modulated light source;

wherein the plurality of sub-regions within each region comprise a first sub-region which emits light having a first central wavelength, a second sub-region which emits light having a second central wavelength and a third sub-region which emits light having a third central wavelength; and further wherein the sub-regions are configured to illuminate an area of the display modulator and further wherein the display modulator comprises a set of color filtered subpixels to provide a wide color gamut.

16. The method according to claim 15, wherein the nano-scale particles comprise quantum dots intersperced in a contiguous plane between the light source layer and the display modulation layer.

17. The method according to claim 15, wherein the nano-scale particles comprise a combination of diffuser materials and one of quantum dots, photo-luminescents, and phosphors.

18. The method according to claim 15, wherein the individually modulated light sources comprise LEDs and the light output characteristics of the individually modulated light sources comprise point spread functions of the LEDs.

19. The method according to claim 15, wherein the light source layer comprises LEDs and wherein the method comprises determining an estimate of the expected characteristics of the second spatially varying light pattern received at the display modulation layer based at least in part on the first drive signals and modified point spread functions of the LEDs, the modified point spread functions incorporating a transfer function of the nano-scale particles which relates light received on the nano-scale particles to light output by the nano-scale particles.

20. The method according to claim 19, wherein the nano-scale particles are disposed in a contiguous plate parallel to the light source layer and the display modulation layer.

* * * * *